US010031433B2

(12) United States Patent
Iioka et al.

(10) Patent No.: US 10,031,433 B2
(45) Date of Patent: Jul. 24, 2018

(54) ELECTROSTATIC CHARGE IMAGE DEVELOPING TONER

(71) Applicant: Konica Minolta, Inc., Tokyo (JP)

(72) Inventors: Atsushi Iioka, Hachioji (JP); Takanari Kayamori, Kawasaki (JP); Naoya Tonegawa, Sagamihara (JP); Masaharu Matsubara, Hachioji (JP); Kouji Sekiguchi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/440,167

(22) Filed: Feb. 23, 2017

(65) Prior Publication Data

US 2017/0255119 A1 Sep. 7, 2017

(30) Foreign Application Priority Data

Mar. 2, 2016 (JP) ..... 2016-039574

(51) Int. Cl.
*G03G 9/093* (2006.01)
*G03G 9/08* (2006.01)

(52) U.S. Cl.
CPC ..... *G03G 9/09364* (2013.01); *G03G 9/0819* (2013.01); *G03G 9/0825* (2013.01); *G03G 9/0827* (2013.01); *G03G 9/09314* (2013.01); *G03G 9/09321* (2013.01); *G03G 9/09328* (2013.01); *G03G 9/09357* (2013.01); *G03G 9/09392* (2013.01)

(58) Field of Classification Search
CPC ..... G03G 9/09328; G03G 9/09371; G03G 9/09314; G03G 9/09321; G03G 9/09364
See application file for complete search history.

(56) References Cited

U.S. PATENT DOCUMENTS

| | | | | |
|---|---|---|---|---|
| 9,740,127 | B2 * | 8/2017 | Komada | G03G 9/09314 |
| 2009/0286176 | A1 | 11/2009 | Ohmura et al. | |
| 2009/0297225 | A1 | 12/2009 | Yamada et al. | |
| 2011/0212398 | A1 * | 9/2011 | Hayashi | G03G 9/0804 430/109.3 |

(Continued)

FOREIGN PATENT DOCUMENTS

| | | | |
|---|---|---|---|
| JP | 2009192957 A | * | 8/2009 |
| JP | 2012194314 A | | 10/2012 |
| JP | 2014048525 A | | 3/2014 |

OTHER PUBLICATIONS

European Search Report dated Jun. 28, 2017 from corresponding European Application No. 17157537.6.

*Primary Examiner* — Christopher D Rodee

(74) *Attorney, Agent, or Firm* — Lucas & Mercanti, LLP

(57) ABSTRACT

An electrostatic charge image developing toner includes a toner matrix particle having a core-shell structure. The toner matrix particle contains: a core particle including an amorphous resin, a colorant, a release agent, and a crystalline resin; and a shell layer coating a surface of the core particle at a coverage of 60 to 99%. The shell layer includes an amorphous resin. The amorphous resin contained in the core particle differs from the amorphous resin contained in the shell layer. The toner matrix particle has one to seven discrete shell domains determined by observation of a cross section of the toner matrix particle with an electron microscope.

18 Claims, 2 Drawing Sheets

(56) References Cited

U.S. PATENT DOCUMENTS

| | | | | |
|---|---|---|---|---|
| 2014/0272689 | A1* | 9/2014 | Yamashita | G03G 9/08795 430/18 |
| 2014/0272695 | A1* | 9/2014 | Moritani | G03G 9/08764 430/105 |
| 2014/0349231 | A1* | 11/2014 | Shirai | G03G 9/0825 430/109.4 |
| 2014/0363763 | A1* | 12/2014 | Shibata | G03G 9/08724 430/109.3 |
| 2014/0377699 | A1* | 12/2014 | Matsushima | G03G 9/0825 430/109.3 |
| 2015/0177632 | A1* | 6/2015 | Imae | G03G 9/09328 430/109.3 |
| 2015/0177633 | A1* | 6/2015 | Kobayashi | G03G 9/09328 430/108.3 |
| 2015/0212438 | A1* | 7/2015 | Sakamoto | G03G 9/09314 430/108.22 |
| 2016/0033887 | A1* | 2/2016 | Liu | G03G 9/09328 430/110.2 |
| 2016/0139524 | A1* | 5/2016 | Okita | G03G 9/09371 430/109.4 |
| 2016/0154333 | A1* | 6/2016 | Sun | G03G 9/09328 430/108.6 |
| 2016/0291492 | A1* | 10/2016 | Fujisaki | G03G 9/08755 |
| 2017/0038696 | A1* | 2/2017 | Sacripante | G03G 9/081 |
| 2017/0052465 | A1* | 2/2017 | Shimano | G03G 9/08711 |
| 2017/0075244 | A1* | 3/2017 | Tamagaki | G03G 9/09321 |
| 2017/0115583 | A1* | 4/2017 | Tsuchihashi | G03G 9/0825 |
| 2017/0168407 | A1* | 6/2017 | Onishi | G03G 9/0804 |
| 2017/0197365 | A1* | 7/2017 | Sugiyama | B29C 67/0077 |
| 2017/0212436 | A1* | 7/2017 | Onishi | G03G 9/081 |
| 2017/0248859 | A1* | 8/2017 | Sacripante | G03G 9/08755 |

* cited by examiner

ELECTROSTATIC CHARGE IMAGE DEVELOPING TONER

BACKGROUND OF THE INVENTION

Field of the Invention

The present invention relates to a toner for developing electrostatic charge images. In particular, the present invention relates to a toner for developing electrostatic charge images, the toner having superior charging properties and high durability, exhibiting high compatibility between low-temperature fixing properties and thermal resistance during storage, exhibiting improved releasability by efficient elution of a release agent from toner particles during fixation for high-speed printing, and providing images with consistent gloss.

Description of Related Art

Recent electrophotographic image forming apparatuses require toners for developing electrostatic charge images (hereinafter may be referred to simply as "toner") having superior low-temperature fixing properties in view of high printing rate and further energy saving for a reduction in environmental load. Such a toner requires a reduction in melting temperature or melting viscosity of a binder resin contained in the toner. Several documents propose toners containing crystalline resins (e.g., crystalline polyester resins) as fixing aids and thus having improved low-temperature fixing properties.

Unfortunately, toner matrix particles consisting of only core particles exhibit poor thermal resistance during storage. Thus, a toner has been proposed which has a core-shell structure composed of core particles exhibiting low-temperature fixing properties and shell layers exhibiting thermal resistance during storage, the core particles being coated with the shell layers.

Unfortunately, in the toner including a core particle and a shell layer composed of different resins, the compatibility between the core particle and the shell layer is lower than that in the case where the core particle and the shell layer are composed of the same resin, and small discrete segments of the shell layer lie on the surface of the core particle (refer to, for example, Japanese Patent Application Laid-Open Publication No. 2012-194314). Thus, the core particle has many exposed portions, resulting in insufficient thermal resistance during storage. In addition, the core particle cannot be evenly coated with an external additive because of the rough surface of the toner. Thus, the toner may fail to exhibit satisfactory charging properties.

A toner composed of core particles completely coated with shell layers may exhibit poor releasability (i.e., inefficient elution of a release agent from the core particles) during fixation for high-speed printing (refer to, for example, Japanese Patent Application Laid-Open Publication No. 2014-048525).

In view of superior low-temperature fixing properties of a core-shell toner and high releasability of the toner during high-speed printing, components contained in core particles are required to be efficiently eluted to the surfaces of toner particles during fixation.

SUMMARY OF THE INVENTION

An object of the present invention, which has been conceived in light of the problems and circumstances described above, is to provide a toner for developing electrostatic charge images, the toner having superior charging properties and high durability, exhibiting high compatibility between low-temperature fixing properties and thermal resistance during storage, exhibiting improved releasability by efficient elution of a release agent from the toner during fixation for high-speed printing, and providing images with consistent gloss.

The present inventors have conducted studies for solving the aforementioned problems and have developed a toner for developing electrostatic charge images, the toner including a toner matrix particle containing a core particle coated with a shell layer at a specific coverage, wherein the core particle contains an amorphous resin different from that contained in the shell layer, and the core matrix particle has one to seven discrete shell domains. The inventors have found that the toner has superior charging properties and high durability, exhibits high compatibility between low-temperature fixing properties and thermal resistance during storage, exhibits improved releasability by efficient elution of a release agent from the toner during fixation for high-speed printing, and provides images with consistent gloss. The present invention has been accomplished on the basis of this finding.

The present invention to solve the problems described above is characterized by the following aspects.

According to a first aspect of the present invention, there is provided an electrostatic charge image developing toner including a toner matrix particle having a core-shell structure, wherein the toner matrix particle contains: a core particle including an amorphous resin, a colorant, a release agent, and a crystalline resin; and a shell layer coating a surface of the core particle at a coverage of 60 to 99%, the shell layer includes an amorphous resin, the amorphous resin contained in the core particle differs from the amorphous resin contained in the shell layer, and the toner matrix particle has one to seven discrete shell domains determined by observation of a cross section of the toner matrix particle with an electron microscope.

Preferably, a content of the crystalline resin is 5 to 40 parts by mass.

Preferably, the amorphous resin contained in the shell layer is a hybrid resin including a segment of an amorphous resin similar to the amorphous resin contained in the toner particle, the segment molecularly bonding to the amorphous resin contained in the core particle.

Preferably, the amorphous resin contained in the shell layer is an amorphous polyester resin.

Preferably, the amorphous resin contained in the core particle is a styrene-acrylic resin.

Preferably, the amorphous polyester resin contained in the shell layer includes a styrene-acrylic modified polyester having a structure including a polyester molecular chain molecularly bonded to a styrene-acrylic copolymer molecular chain.

Preferably, the crystalline resin is a crystalline polyester resin.

Preferably, each of the shell domains is in a continuous phase.

Preferably, the shell layer coats the surface of the core particle at a coverage of 80 to 90%.

Preferably, a following expression is satisfied: an average of lengths L is equal to or greater than ⅛ of a perimeter of the core particle, where L represents a length of an interface between the core particle and a shell domain determined by observation of a cross section of the toner matrix particle.

Preferably, a shape factor SF-2 of the toner matrix particle and a shape factor SF-2 of the core particle satisfy Expression (1): the shape factor SF-2 of the core particle>the shape factor SF-2 of the toner matrix particle.

As described above, the present invention provides a toner for developing electrostatic charge images, the toner having superior charging properties and high durability, exhibiting high compatibility between low-temperature fixing properties and thermal resistance during storage, exhibiting improved releasability by efficient elution of a release agent from the toner during fixation for high-speed printing, and providing images with consistent gloss.

The mechanisms and operations that establish the advantageous effects of the present invention are inferred as described below.

The toner of the present invention exhibits high thermal resistance during storage and high durability because the core particle is coated with the shell layer at a high coverage (i.e., 60 to 99%).

The coverage is 60 to 99%; i.e., the core particle is not completely coated with the shell layer, but is partially exposed. Thus, the release agent contained in the core particle is efficiently eluted during fixation, resulting in high releasability. The crystalline resin contained in the core particle is also efficiently eluted during fixation, leading to effective mixing between melted toner matrix particles, resulting in high fixation intensity.

The toner of the present invention exhibits high thermal resistance during storage and high durability (reduction in stress caused by mixing in a developing unit), superior low-temperature fixing properties, and high releasability because the toner matrix particle contains the core particle coated with the shell layer at the aforementioned coverage.

The core particle containing the release agent is coated with the shell layer containing a resin different from that contained in the core particle (i.e., a resin having low compatibility with that contained in the core particle), resulting in reduced exposure of the release agent in the core particle to the surface of the toner matrix particle, and thus improved storage stability.

Since the core particle and the shell layer are mainly composed of an amorphous resin, an image formed through fixation exhibits reduced gloss and improved gloss stability.

BRIEF DESCRIPTION OF THE DRAWINGS

The present invention will become more fully understood from the detailed description given hereinbelow and the appended drawings, and thus are not intended as a definition of the limits of the present invention, and wherein.

PREFERRED EMBODIMENT OF THE PRESENT INVENTION

Figure 1:
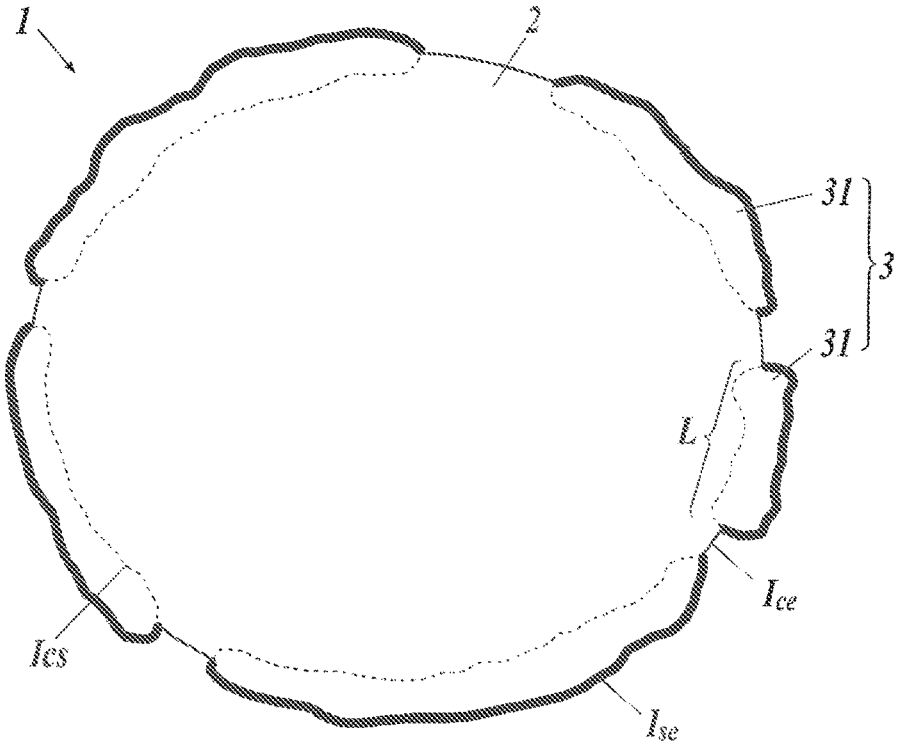
FIG. 1 is a schematic cross-sectional view of a toner matrix particle according to the present invention.

The present invention provides a toner for developing electrostatic charge images, the toner including a toner matrix particle having a core-shell structure. The toner matrix particle includes a core particle and a shell layer, the core particle containing an amorphous resin, a colorant, a release agent, and a crystalline resin, and being coated with the shell layer at a coverage of 60 to 99%. The shell layer includes an amorphous resin. The amorphous resin contained in the core particle differs from the amorphous resin contained in the shell layer. The toner matrix particle has one to seven discrete shell domains determined by observation of a cross section of the toner matrix particle with an electron microscope. These technical characteristics are common in the aspects of the present invention.

In an embodiment of the present invention, the content of the crystalline resin is preferably 5 to 40 parts by mass in view of a further improvement in low-temperature fixing properties and a reduction in gloss of an image formed through fixation.

In the present invention, the amorphous resin contained in the shell layer is preferably a hybrid resin including a segment of an amorphous resin similar to the amorphous resin contained in the toner particle, the segment molecularly bonding to the amorphous resin contained in the core particle, in view of an improvement in the compatibility between the amorphous resin contained in the shell layer and the resin mainly contained in the core particle, resulting in high toner retention after fixation.

In an embodiment of the present invention, the amorphous resin contained in the shell layer is preferably an amorphous polyester resin that can readily design a toner having high glass transition temperature ($T_g$), low softening point ($T_{sp}$), and improved low-temperature fixing properties.

In an embodiment of the present invention, the amorphous resin contained in the core particle is preferably a styrene-acrylic resin that can yield a toner exhibiting charging properties stable against environmental variations (e.g., variations in humidity and temperature).

In an embodiment of the present invention, the amorphous polyester resin contained in the shell layer preferably contains a styrene-acrylic modified polyester having a structure including a polyester molecular chain molecularly bonded to a styrene-acrylic copolymer molecular chain, in view of an improvement in the compatibility between the amorphous polyester resin contained in the shell layer and the resin mainly contained in the core particle, resulting in high toner retention after fixation.

In an embodiment of the present invention, the crystalline resin is preferably a crystalline polyester resin that can reduce adhesion between sheets having images formed through thermal fixation of the toner.

In an embodiment of the present invention, each of the shell domains is preferably in a continuous phase in view of a reduction in excess elution of components contained in the core particle.

In an embodiment of the present invention, the core particle is preferably coated with the shell layer at a coverage of 80 to 90% in view of a further improvement in thermal resistance during storage and high compatibility between the durability and releasability of the toner.

In an embodiment of the present invention, the following expression is preferably satisfied:

the average of lengths L is equal to or greater than ⅛ of the perimeter of the core particle, where L (see FIG. 1) represents the length of the interface between the core particle and a shell domain determined by observation of a cross section of the toner matrix particle. This configuration contributes to a reduction in excess elution of components contained in the core particle.

In an embodiment of the present invention, the shape factor SF-2 of the toner matrix particle and the shape factor SF-2 of the core particle preferably satisfy Expression (1). This configuration contributes to reduced surface roughness (i.e., smooth surface) of the toner matrix particle and even deposition of an external additive onto the particle.

The present invention, its components, and embodiments and aspects for implementing the present invention will now be described in detail. As used herein, the term "to" between two numerical values indicates that the numeric values before and after the term are inclusive as the lower limit value and the upper limit value, respectively.

<<Toner for Developing Electrostatic Charge Images>>

The present invention provides a toner for developing electrostatic charge images, the toner including toner matrix particles having a core-shell structure. The toner matrix particles each contain a core particle and a shell layer, the core particle including an amorphous resin, a colorant, a release agent, and a crystalline resin, and being coated with the shell layer at a coverage of 60 to 99%. The shell layer contains an amorphous resin. The amorphous resin contained in the core particle differs from the amorphous resin contained in the shell layer. Each toner matrix particle has one to seven discrete shell domains determined by observation of a cross section of the toner matrix particle with an electron microscope.

In the present invention, "toner" is composed of "toner particles."

<<Toner Matrix Particles>>

The toner matrix particles according to the present invention have a core-shell structure. The toner matrix particles having an external additive are preferably used as toner particles, although the toner matrix particles having no external additive may be used as toner particles.

The toner matrix particles according to the present invention have a volume median particle size (D50) of preferably 3 to 10 μm, more preferably 5.5 to 7 μm.

<Core-shell Structure>

In the present invention, the core-shell structure is composed of a core particle and a shell layer covering the core particle. In the present invention, the amorphous resin contained in the core particle differs from the amorphous resin contained in the shell layer.

<<Shell Layer>>

The shell layer contains an amorphous resin, and the core particle is coated with the shell layer at a coverage of 60 to 99%. The coverage is preferably 80 to 90% in view of a further improvement in thermal resistance during storage and high compatibility between the durability and releasability of the toner.

The coverage is 60 to 99% in the toner of the present invention. A coverage of 60% or more leads to prevention of excess exposure of the surface of the core particle, resulting in compatibility between thermal resistance during storage and durability, whereas a coverage of 99% or less leads to efficient elution of the release agent during fixation, resulting in improved releasability.

The coverage can be controlled by adjustment of the temperature and heating period during fusion of shell particles coagulated with core particles, or the amounts of resins used for preparation of the particles.

The shell layer according to the present invention is composed of one to seven discrete shell domains that are determined by observation of a cross section of one toner matrix particle with an electron microscope.

The shell layer (shell domains) can be determined through observation of a cross section of a toner particle.

[Observation of Cross Section of Toner Particle]

In the present invention, a cross section of a toner particle is observed under the following conditions:

Apparatus: transmission electron microscope "JSM-7401F" (manufactured by JEOL Ltd.)

Sample: a section of a toner particle stained with ruthenium tetroxide ($RuO_4$) (thickness of section: 60 to 100 nm)

Accelerating voltage: 30 kV

Magnification: 10,000 to 20,000

Conditions for observation: transmission electron detector, bright field image (Preparation of Section of Toner Particle)

A toner (1 to 2 mg) is placed into a 10-mL sample vial and stained with vaporized ruthenium tetroxide ($RuO_4$) as described below. The resultant toner is dispersed (embedded) in a photocurable resin (hereinafter may be referred to as "embedding resin") "D-800" (manufactured by JEOL Ltd.) and then photo-cured to form a block. The block is then sliced with a microtome having a diamond knife into an ultrathin sample having a thickness of 60 to 100 nm.

(Treatment with Ruthenium Tetroxide)

The ruthenium tetroxide treatment involves the use of a vacuum electron staining apparatus VSC1R1 (manufactured by Filgen, Inc.). In detail, the toner or ultrathin sample is introduced into a ruthenium tetroxide-containing sublimation chamber (staining chamber) provided in the apparatus, and then stained with ruthenium tetroxide at room temperature (24 to 25° C.) and concentration level 3 (300 Pa) for 10 minutes.

(Observation of Dispersed Particles)

A cross-sectional image of toner matrix particles is captured with an electron microscope "JSM-7401F" (manufactured by JEOL Ltd.) within 24 hours after staining.

FIG. 1 is a schematic cross-sectional view of a toner matrix particle according to an embodiment of the present invention captured with an electron microscope by the method described above.

As illustrated in FIG. 1, a toner matrix particle 1 includes a core particle 2 and a shell layer 3 covering the surface of the core particle 2. The shell layer 3 is composed of one to seven discrete shell domains 31.

The thick solid line represents the interface $I_{se}$, between the shell layer and the embedding resin described above. The thin solid line represents the interface $I_{ce}$, between the core particle and the embedding resin. The dotted line represents the interface $I_{cs}$ between the core particle and the shell layer.

Figure 2:
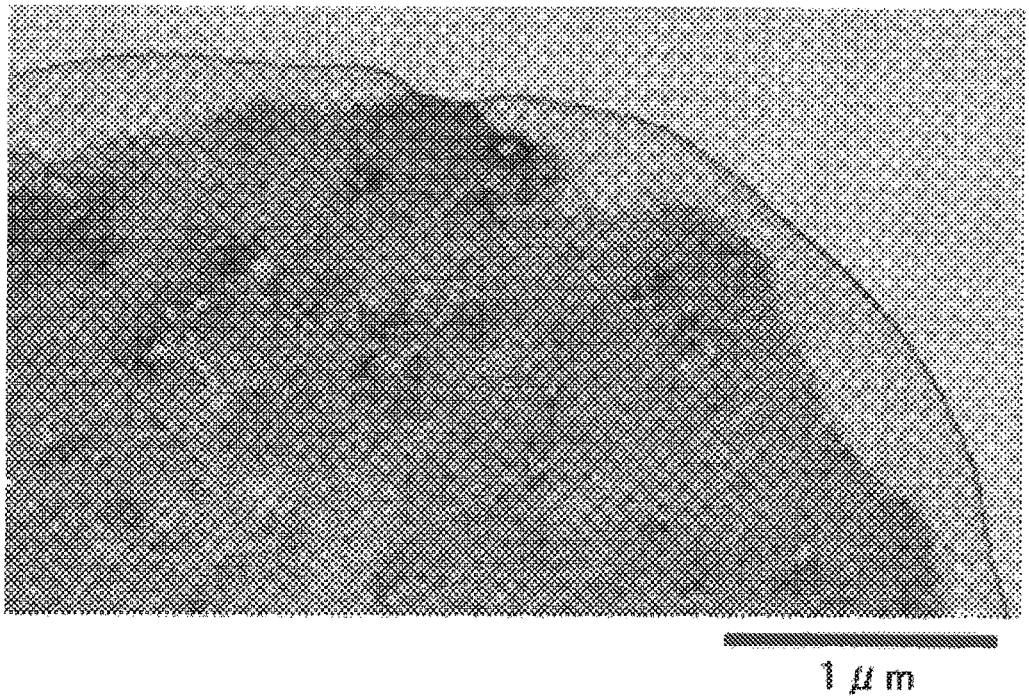
FIG. 2 is an electron microscopic cross-sectional view of a toner matrix particle according to the present invention.

FIG. 2 is a cross-sectional image of a toner matrix particle.

Toner particles are analyzed on the basis of data prepared by photographing (20 or more visual fields) of cross sections having a diameter within a range of volume median particle size (D50) of toner particles±10%.

In the present invention, 20 or more toner matrix particles are preferably subjected to cross-sectional photography with an electron microscope.

(Determination of Volume Median Particle Size of Toner Particles)

The volume median particle size (D50) of toner particles can be determined with an apparatus "Multisizer 3" (manufactured by Beckman Coulter, Inc.) equipped with a computer system for data processing.

In detail, toner particles (0.02 g) are placed in a surfactant solution (e.g., prepared by 10-fold dilution of a surfactant-containing neutral detergent with pure water) (20 mL), followed by ultrasonic dispersion for one minute, to prepare a toner particle dispersion.

The toner particle dispersion is injected, with a pipette, into a beaker containing ISOTON II (manufactured by Beckman Coulter, Inc.) in a sample stand to achieve a concentration of 5 to 10%, followed by measurement with a counter (25,000 counts).

The apparatus Multisizer 3 has an aperture diameter of 100 μm. The range of 1 to 30 μm is divided into 256 fractions, and the frequency in each fraction is calculated. The particle size at 50% of the volume-integrated fraction from the larger particles is defined as the volume median particle size (D50).

The volume median particle size (D50) of toner particles can be controlled through adjustment of the concentration of a coagulant used in the aforementioned process, the amount of an organic solvent used in the process, or the period of time for fusion.

[Determination of Coverage]

The coverage of the shell layer in a toner matrix particle is calculated on the basis of the cross section of the toner matrix particle observed as described above.

In detail, the cross section of the toner matrix particle is photographed with an electron microscope (JSM-7401F (manufactured by JEOL Ltd.) (accelerating voltage: 30 kV, magnification: 10,000 to 20,000). The photographic image is analyzed with an image processing analyzer LUZEX AP (manufactured by NIRECO CORPORATION) for determination of the length of the interface between the shell domains and the embedding resin and the perimeter of the cross section of the toner matrix particle.

The coverage of the shell layer is calculated by the following expression:

$$\text{coverage}=(A/B)\times 100$$

where A represents the length of the interface between the shell domains and the embedding resin, and B represents the perimeter of the cross section of the toner matrix particle.

The presence of a core-shell structure in the toner according to the present invention can be confirmed by the photographic image of the toner cross section; i.e., observation of a black (or gray) region corresponding to the core particle containing the colorant or the release agent, and a white region corresponding to the shell domains (i.e., surface layer of the toner matrix particle). The colorant cannot be identified during observation of the cross section stained under the aforementioned conditions. In the observed core particle, a white portion corresponds to the release agent while a black (or gray) portion corresponds to the crystalline polyester resin where the black portion is darker than a portion corresponding to the amorphous resin contained in the core particle.

[Shell Domain]

In the present invention, each shell domain in contact with the surface of the core particle has a thickness of 0.7 to 18% of the volume median particle size (D50) of the toner matrix particles and an interfacial length of 1.5% or more of the volume median particle size (D50) of the toner matrix particles.

In the present invention, the shell layer is composed of the shell domains.

Each shell domain preferably has a continuous phase (no cracks in the shell domain) in view of preventing excess elution of the components contained in the core particle through such cracks. Such a continuous phase is preferred in view of prevention of breakage of the shell layer, resulting in reduced elution of the components contained in the core particle.

Whether each shell domain has a continuous phase (i.e., no cracks) can be determined by observation of a cross section of the toner matrix particle with a transmission electron microscope at a magnification of preferably 10,000 to 20,000.

Figure 3:
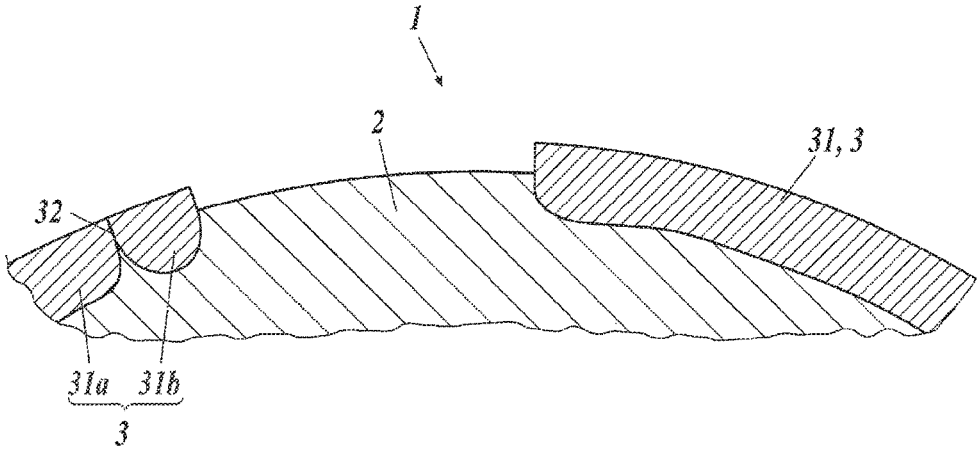
FIG. 3 is a schematic illustration of the interface between shell domains.

The interface between shell domains will now be described with reference to FIG. 3. FIG. 3 is a schematic partial cross-sectional view of a toner matrix particle having shell domains that are in contact with each other at the interface. As illustrated in FIG. 3, a shell domain 31*a* is in contact with a shell domain 31*b* at the interface 32. In the present invention, the shell domain of continuous phase does not have such an interface.

<Determination of the Number of Shell Domains>

The number of shell domains is determined on the basis of the cross-sectional image of the toner matrix particle used for calculation of the coverage.

In the cross-sectional image of the toner matrix particle illustrated in FIG. 2, a shell domain corresponds to a white region having a thickness of 0.7 to 18% of the volume median particle size (D50) of the toner matrix particles and being in contact with the core particle at the interface having a length of 1.5% or more of the volume median particle size (D50) of the toner matrix particles. The number of such discrete shell domains is counted.

<Interfacial Length L between Core Particle and Shell Layer and Perimeter of Core Particle>

In the present invention, the following expression is preferably satisfied:

the average of lengths L is equal to or greater than ⅛ of the perimeter of a core particle, where L represents the length of the interface between the core particle and a shell domain determined by observation of a cross section of a toner matrix particle. In this case, the core particle is coated with laminar shells (rather than particulate shell domain) and the matrix particle has a smooth surface, resulting in even deposition of an external additive and stable charging properties.

In each toner matrix particle, the average of lengths L is preferably ⅞ or less of the perimeter of the core particle, in view of efficient elution of a release agent from the toner particle.

(Calculation of Perimeter of Core Particle and Average Length L of Interface between Core Particle and Shell Layer)

The perimeter of the core particle and the length L of the interface between the core particle and the shell layer are calculated on the basis of the cross-sectional image of the toner matrix particle.

In detail, the cross section of the toner matrix particle is photographed with a transmission electron microscope JEM-2000FX (manufactured by JEOL Ltd.) (accelerating voltage: 30 kV, magnification: 10,000 to 20,000). The resultant cross-sectional image of the toner matrix particle is analyzed with an image processing analyzer LUZEX AP (manufactured by NIRECO CORPORATION) for determination of the perimeter of the core particle and the length L of the interface between the core particle and the shell layer.

In the toner matrix particle, the average of the lengths L of core particle-shell layer interfaces corresponds to the quotient of the sum of the lengths L divided by the number of shell domains.

[Amorphous Resin Contained in Shell Layer]

The amorphous resin has a glass transition temperature ($T_g$) but no melting point (i.e., no clear endothermic peak during the heating process) in a thermal curve prepared by differential scanning calorimetry (DSC).

The amorphous resin contained in the shell layer may be of any type, such as a styrene-acrylic resin or an amorphous polyester resin described below. Particularly preferred is an amorphous polyester resin.

In the toner matrix particle, the amorphous resin contained the shell layer differs from the amorphous resin contained in the core particle.

As used herein, the term "different amorphous resins" refers to amorphous resins composed of different types of monomers, and does not refer to amorphous resins having different monomer proportions or amorphous resins with or without modification (e.g., styrene-acrylic modified polyester resins described below). In the core-shell toner containing different resins, the core particle or the shell layer contains different resin components in an amount of 50% or more.

Different types of resins may be detected by any known technique; for example, staining described in Examples, or atomic force microscopy (AFM) that can determine the difference in the hardness or infrared absorption wavelength of a resin present in a cross section.

The amorphous resin contained in the shell layer is preferably an amorphous polyester resin that can design a toner having high glass transition temperature ($T_g$), low softening point ($T_{sp}$), and improved low-temperature fixing properties.

The amorphous resin contained in the shell layer may be any resin other than the aforementioned amorphous resins. For example, the amorphous resin contained in the shell layer may be a hybrid resin including a segment of an amorphous resin (hereinafter may be referred to as "amorphous resin segment") similar to the amorphous resin contained in the toner particle, the segment molecularly bonding to the amorphous resin contained in the core particle. Such a hybrid resin is preferred because it can improve the compatibility between the amorphous resin contained in the shell layer and the resin mainly contained in the core particle, resulting in high toner retention after fixation.

The amorphous polyester resin contained in the shell layer may be a hybrid resin. For a core particle composed of an amorphous styrene-acrylic resin, the amorphous polyester resin contained in the shell layer preferably contains a styrene-acrylic modified polyester having a structure including a polyester molecular chain molecularly bonded to a styrene-acrylic copolymer molecular chain, in view of an improvement in the compatibility between the amorphous polyester resin contained in the shell layer and the resin mainly contained in the core particle, resulting in high toner retention after fixation.

In the present invention, the amount of the styrene-acrylic copolymer segment contained in the styrene-acrylic modified polyester resin in the shell layer (hereinafter, the amount may be referred to as "styrene-acrylic content") is preferably 5 to 30 mass %, particularly preferably 5 to 20 mass %. A styrene-acrylic content falling within the above range leads to high compatibility of the styrene-acrylic modified polyester resin with the main resin (styrene-acrylic resin) contained in the core particle, resulting in improved releasability of the core-shell toner during fixation, and high toner retention after fixation. A styrene-acrylic content of 30 mass % or less leads to a sufficient proportion of the main resin (amorphous resin) contained in the shell layer, resulting in improved thermal resistance during storage.

In specific, the styrene-acrylic content corresponds to the proportion of the total mass of the aromatic vinyl monomer and the (meth)acrylate monomer to the total mass of the materials used for the synthesis of the styrene-acrylic modified polyester resin; i.e., the total mass of the monomer for the unmodified polyester resin (to form the polyester segment), the aromatic vinyl monomer and (meth)acrylate monomer for the styrene-acrylic copolymer segment, and the bireactive monomer for bonding these segments.

The content of the styrene-acrylic modified polyester resin in the shell layer is preferably 70 to 100 mass %, more preferably 90 to 100 mass %, relative to the total amount (100 mass %) of the resins forming the shell layer.

A styrene-acrylic modified polyester resin content of the shell layer of 70 mass % or more leads to sufficient compatibility between the core particle and the shell and formation of a desired shell, so that unsatisfactory thermal resistance during storage, charging properties, and fracture resistance may be prevented.

The total amount of the aromatic vinyl monomer and the (meth)acrylate monomer is preferably 5 to 30 mass %, particularly preferably 5 to 20 mass %, relative to the total amount (100 mass %) of the resin materials used for the preparation of the styrene-acrylic modified polyester resin; i.e., the total amount of the unmodified polyester resin, the aromatic vinyl monomer, the (meth)acrylate monomer, and the bireactive monomer.

It is preferred that the proportion of the total mass of the aromatic vinyl monomer and the (meth)acrylate monomer to the total mass of the resin materials falls within the above range. A proportion within the above range leads to appropriate control of the compatibility between the styrene-acrylic modified polyester resin and the core particle and formation of a desired shell, resulting in improved releasability of the toner during fixation, and high toner retention after fixation.

A proportion of 5 mass % or more leads to formation of a desired shell with the styrene-acrylic modified polyester resin and prevention of excessive exposure of the core particle, resulting in sufficient thermal resistance during storage and charging properties of the toner.

A proportion of 30 mass % or less leads to prevention of an excessive increase in the softening point of the styrene-acrylic modified polyester resin, resulting in satisfactory low-temperature fixing properties of the toner.

The relative proportion of the aromatic vinyl monomer and the (meth)acrylate monomer is preferably adjusted to achieve a glass transition temperature ($T_g$) determined by Expression (A) (FOX expression) of 35 to 80° C., preferably 40 to 60° C.

$$1/T_g=\Sigma(Wx/T_gx) \qquad \text{Expression (A)}$$

where Wx represents the mass fraction of monomer x, and $T_gx$ represents the glass transition temperature of a homopolymer of monomer x.

In the present invention, a bireactive monomer is not used for the calculation of glass transition temperature.

The amount of the bireactive monomer is preferably 0.1 to 10.0 mass %, particularly preferably 0.5 to 3.0 mass %, relative to the total amount (100 mass %) of the resin materials used for the preparation of the styrene-acrylic modified polyester resin; i.e., the total amount of the unmodified polyester resin, the aromatic vinyl monomer, the (meth)acrylate monomer, and the bireactive monomer.

<Styrene-acrylic Resin>

The styrene-acrylic resin is prepared through polymerization of a styrene monomer and an acrylic monomer.

The styrene-acrylic resin preferably has a weight average molecular weight (Mw) of 25,000 to 60,000 and a number average molecular weight (Mn) of 8,000 to 15,000, which ensure the gloss stability and low-temperature fixing properties of the toner.

The styrene-acrylic resin has a glass transition temperature ($T_{gs}$) of preferably 35 to 50° C., more preferably 38 to 48° C. in view of low-temperature fixing properties.

Examples of the polymerizable monomer used for the styrene-acrylic resin include aromatic vinyl monomers and (meth)acrylate monomers. The polymerizable monomer preferably has a radically polymerizable ethylenically unsaturated bond.

Examples of the styrene monomers (aromatic vinyl monomers) include styrene, o-methylstyrene, m-methylstyrene, p-methylstyrene, α-methylstyrene, p-methoxystyrene, p-phenylstyrene, p-chlorostyrene, p-ethylstyrene, p-n-butylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and derivatives thereof. These aromatic vinyl monomers may be used alone or in combination.

Examples of the (meth)acrylate monomers include n-butyl acrylate, methyl acrylate, ethyl acrylate, isopropyl acrylate, t-butyl acrylate, isobutyl acrylate, n-octyl acrylate, 2-ethylhexyl acrylate, stearyl acrylate, lauryl acrylate, phenyl acrylate, cyclohexyl acrylate, phenyl acrylate, methyl methacrylate, ethyl methacrylate, butyl methacrylate, isopropyl methacrylate, isobutyl methacrylate, butyl methacrylate, octyl methacrylate, 2-ethylhexyl methacrylate, stearyl methacrylate, dodecyl methacrylate, phenyl methacrylate, 2-(diethylamino)ethyl methacrylate, 2-(dimethylamino) ethyl methacrylate, hexyl methacrylate, 2-ethylhexyl methacrylate, β-hydroxyethyl acrylate, γ-aminopropyl acrylate, stearyl methacrylate, dimethylaminoethyl methacrylate, and diethylaminoethyl methacrylate. These (meth)acrylate monomers may be used alone or in combination. Preferred is a combination of a styrene monomer and an acrylate or methacrylate monomer.

The polymerizable monomer may contain a third vinyl monomer. Examples of the third vinyl monomer include acid monomers, such as acrylic acid, methacrylic acid, maleic anhydride, and vinylacetic acid; and miscellaneous monomers, such as acrylamide, methacrylamide, acrylonitrile, ethylene, propylene, butylene, vinyl chloride, N-vinylpyrrolidone, and butadiene.

The polymerizable monomer may be a polyfunctional vinyl monomer. Examples of the polyfunctional vinyl monomer include diacrylates of ethylene glycol, propylene glycol, butylene glycol, and hexylene glycol, divinylbenzene, and dimethacrylates and trimethacrylates of tri- or higher-valent alcohols, such as pentaerythritol and trimethylolpropane.

(Preparation of Styrene-acrylic Resin)

The styrene-acrylic resin according to the present invention is preferably prepared by any emulsion polymerization process. In the emulsion polymerization process, the styrene-acrylic resin is prepared through polymerization of a polymerizable monomer (e.g., styrene or acrylate) dispersed in an aqueous medium described below. A surfactant is preferably used for dispersion of the polymerizable monomer in an aqueous medium. Any known polymerization initiator or chain transfer agent may be used for polymerization of the polymerizable monomer.

(Polymerization Initiator)

Any known polymerization initiator is suitable for use in the present invention. Examples of the polymerization initiator include peroxides, such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, di-t-butyl peroxide, tetralin hydroperoxide, 1-phenyl-2-methylpropyl-1-hydroperoxide, tert-butyl triphenylperacetate hydroperoxide, tert-butyl performate, tert-butyl peracetate, tert-butyl perbenzoate, tert-butyl phenylperacetate, tert-butyl methoxyperaceate, and tert-butyl N-(3-toluyl)perpalmitate; and azo compounds, such as 2,2'-azobis(2-aminodipropane) hydrochloride, 2,2'-azobis-(2-aminodipropane) nitrate, 1,1'-azobis(sodium 1-methylbutyronitrile-3-sulfonate), 4,4'-azobis-4-cyanovaleric acid, and poly(tetraethylene glycol-2,2'-azobisisobutyrate).

(Chain Transfer Agent)

The chain transfer agent may be of any type. Examples of the chain transfer agent include mercaptans, such as octyl mercaptane, dodecyl mercaptan, alkyl mercaptan, and t-dodecyl mercaptan; mercaptopropionates, such as n-octyl 3-mercaptopropionate and stearyl 3-mercaptopropionate; mercapto-fatty acid esters; and styrene dimers. These chain transfers may be used alone or in combination.

The amount of the chain transfer agent may vary depending on the intended molecular weight or molecular weight distribution of the styrene-acrylic copolymer segment. The amount of the chain transfer agent is preferably 0.1 to 5 mass % relative to the total amount of the aromatic vinyl monomer, the (meth)acrylate monomer, and the bireactive monomer.

<Amorphous Polyester Resin>

The amorphous polyester resin is preferably a hybrid resin composed of an amorphous resin segment similar to the amorphous resin contained in the core particle, the segment molecularly bonding to the amorphous resin in the core particle. In specific, the amorphous polyester resin is preferably an amorphous styrene-acrylic modified polyester resin (hybrid resin). As used herein, the term "styrene-acrylic modified polyester resin" refers to a resin (hybrid resin) having a polyester molecular structure including an amorphous polyester chain (hereinafter may be referred to as "polyester segment") molecularly bonded to a styrene-acrylic copolymer molecular chain (hereinafter may be referred to as "styrene-acrylic copolymer segment"). Thus, the styrene-acrylic modified polyester resin has a copolymeric structure including the styrene-acrylic copolymer segment molecularly bonded to the amorphous polyester segment.

The amorphous resin may be such a styrene-acrylic modified polyester resin having a structure composed of a styrene-acrylic copolymer molecular chain molecularly bonded to a polyester molecular chain; i.e., a resin composed of a styrene-acrylic modified polyester resin molecularly bonded to another amorphous resin.

The styrene-acrylic modified polyester resin serving as the amorphous polyester resin is clearly distinguished from the hybrid crystalline polyester resin as described below. Unlike the crystalline polyester resin segment of the hybrid crystalline polyester resin, the polyester segment of the amorphous styrene-acrylic modified polyester resin is an amorphous molecular chain having no clear melting point (i.e., no clear endothermic peak during temperature elevation) and a relatively high glass transition temperature ($T_g$). These properties can be confirmed through differential scanning calorimetry (DSC) of the toner. The monomer for the amorphous polyester segment has a chemical structure different from that of the monomer for the crystalline polyester resin segment, and thus these monomers can be distinguished from each other by, for example, NMR analysis.

The polyester segment is composed of a polyhydric alcohol component and a polyvalent carboxylic acid component.

The polyhydric alcohol component may be of any type. The polyhydric alcohol component is preferably an aromatic diol or a derivative thereof in view of the charging properties and strength of the toner. Examples of the aromatic diol and its derivative include bisphenols, such as bisphenol A and bisphenol F; and alkylene oxide adducts of bisphenols, such as ethylene oxide adducts and propylene oxide adducts of bisphenols.

Among these polyhydric alcohol components, preferred are ethylene oxide adducts and propylene oxide adducts of bisphenol A in view of an improvement in charging uniformity. These polyhydric alcohol components may be used alone or in combination.

Examples of the polyvalent carboxylic acid component condensed with the polyhydric alcohol component include aromatic carboxylic acids, such as terephthalic acid, isophthalic acid, phthalic anhydride, trimellitic anhydride, pyromellitic acid, and naphthalenedicarboxylic acid; aliphatic carboxylic acids, such as fumaric acid, maleic anhydride, and alkenylsuccinic acid; and lower alkyl esters and anhydrides of these acids. These polyvalent carboxylic acid components may be used alone or in combination.

The amorphous polyester resin preferably has a number average molecular weight (Mn) of 2,000 to 10,000 in view of easy control of the plasticity of the component.

The amorphous polyester resin preferably has a glass transition temperature ($T_g$) of preferably 20 to 70° C. The glass transition temperature ($T_g$) can be determined in accordance with the method (DSC method) specified in American Society for Testing and Materials (ASTM) standard D3418-82. The glass transition temperature ($T_g$) can be determined with, for example, a differential scanning calorimeter DSC-7 (manufactured by PerkinElmer Inc.) or a thermal analysis controller TAC7/DX (manufactured by PerkinElmer Inc.).

(Preparation of Amorphous Polyester Segment)

The amorphous polyester segment may be prepared through any known process. For example, the amorphous polyester segment can be prepared through polycondensation (esterification) of a polyvalent carboxylic acid and a polyhydric alcohol in the presence of any known esterification catalyst.

Examples of the known esterification catalyst usable for the preparation of the amorphous polyester segment include compounds of alkali metals, such as sodium and lithium; compounds containing group 2 elements, such as magnesium and calcium; compounds of metals, such as aluminum, zinc, manganese, antimony, titanium, tin, zirconium, and germanium; phosphite compounds; phosphate compounds; and amine compounds. Specific examples of the tin compound include dibutyltin oxide, tin octylate, tin dioctylate, and salts thereof. Examples of the titanium compound include titanium alkoxides, such as tetra-n-butyl titanate, tetraisopropyl titanate, tetramethyl titanate, and tetrastearyl titanate; titanium acylates, such as polyhydroxytitanium stearate; and titanium chelate compounds, such as titanium tetraacetylacetonate, titanium lactate, and titanium triethanolaminate. Examples of the germanium compound include germanium dioxide. Examples of the aluminum compounds include oxides, such as poly(aluminum hydroxide); aluminum alkoxides; and tributyl aluminate. These compounds may be used alone or in combination.

The polymerization may be performed at any temperature. The polymerization temperature is preferably 150 to 250° C. The polymerization may be performed for any period of time. The polymerization time is preferably 0.5 to 10 hours. The polymerization may optionally be performed in a reaction system at reduced pressure.

(Styrene-acrylic Copolymer Segment)

The styrene-acrylic copolymer segment is prepared through addition polymerization of at least a styrene monomer and a (meth)acrylate monomer. As used herein, the "styrene monomer" includes styrene, which is represented by the formula $CH_2{=}CH{-}C_6H_5$, and styrene derivatives having known side chains or functional groups in the styrene structure. As used herein, the "(meth)acrylate monomer" includes acrylate and methacrylate compounds represented by the formula $CH_2{=}CHCOOR$ (where R is an alkyl group), and ester compounds having known side chains or functional groups in the structure of acrylate or methacrylate derivatives.

Preferred examples of the styrene monomers and the (meth)acrylate monomers that can form styrene-acrylic copolymer segments include aromatic vinyl monomers and (meth)acrylate monomers described in the section <styrene-acrylic resin>. Other styrene monomers and (meth)acrylate monomers may also be used in the present invention for formation of the styrene-acrylic copolymer segment.

As used herein, the term "(meth)acrylate monomers" collectively refers to "acrylate monomers" and "methacrylate monomers." For example, "methyl (meth)acrylate" collectively refers to "methyl acrylate" and "methyl methacrylate."

These acrylate or methacrylate monomers may be used alone or in combination. In detail, the copolymer can be prepared from styrene monomer in combination with two or more acrylate monomers, styrene monomer in combination with two or more methacrylate monomers, or styrene monomer in combination with acrylate monomer and methacrylate monomer.

The content of the structural unit derived from the styrene monomer is preferably 40 to 90 mass % relative to the entire amount of the amorphous resin segment. The content of the structural unit derived from the (meth)acrylate monomer is preferably 10 to 60 mass % relative to the entire amount of the amorphous resin segment. These structural units having contents within such ranges facilitate control of the plasticity of the hybrid resin.

The amorphous resin segment is preferably prepared through addition polymerization of the styrene monomer, the (meth)acrylate monomer, and a compound that chemically bonds to the amorphous polyester segment. Particularly preferred is the use of a compound that forms an ester bond with the hydroxyl group [—OH] derived from the polyhydric alcohol or the carboxyl group [—COOH] derived from the polyvalent carboxylic acid contained in the amorphous polyester segment. Thus, the amorphous resin segment is preferably prepared through polymerization of the styrene monomer, the (meth)acrylate monomer, and a compound that can addition-polymerize with the styrene monomer and the (meth)acrylate ester monomer and that has a carboxyl group [—COOH] or a hydroxyl group [—OH].

Examples of such a compound include compounds having a carboxyl group, such as acrylic acid, methacrylic acid, maleic acid, itaconic acid, cinnamic acid, fumaric acid, monoalkyl maleates, and monoalkyl itaconates; and compounds having a hydroxyl group, such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and poly(ethylene glycol) mono(meth)acrylate.

The content of the structural unit derived from the aforementioned compound is preferably 0.5 to 20 mass % relative to the total amount of the amorphous resin segments.

The styrene-acrylic copolymer segment may be prepared by any process; for example, polymerization of a monomer in the presence of any known oil- or water-soluble polymerization initiator. Specific examples of the oil-soluble polymerization initiator include azo or diazo polymerization initiators and peroxide polymerization initiators described below.

Examples of the azo or diazo polymerization initiators include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Examples of the peroxide polymerization initiators include benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine.

A water-soluble radical polymerization initiator can be used in preparation of resin particles by emulsion polymerization. Examples of the water-soluble polymerization initiator include persulfates, such as potassium persulfate and ammonium persulfate; azobisaminodipropane acetate; azobiscyanovaleric acid and salts thereof; and hydrogen peroxide.

(Preparation of Styrene-acrylic Modified Polyester Resin)

The styrene-acrylic modified polyester resin may be prepared by any process that can produce a polymer having a structure composed of the amorphous polyester segment and the styrene-acrylic copolymer segment molecularly bonded thereto. Specific examples of the process of preparing the styrene-acrylic modified polyester resin include the following processes (1) to (3):

(1) Polymerization of an amorphous polyester segment in the presence of preliminarily polymerized styrene-acrylic copolymer segments to prepare a styrene-acrylic modified polyester resin.

In process (1), monomers, preferably vinyl monomers, e.g., a styrene monomer and a (meth)acrylate monomer are polymerized into a styrene-acrylic copolymer segment through addition reaction. A polyvalent carboxylic acid and a polyhydric alcohol are then polymerized into an amorphous polyester segment in the presence of the styrene-acrylic copolymer segment. While the polyvalent carboxylic acid and the polyhydric alcohol are subjected to condensation reaction, the styrene-acrylic copolymer segments are bonded by addition reaction to the polyvalent carboxylic acid or the polyhydric alcohol, to prepare a styrene-acrylic modified polyester resin.

Process (1) preferably involves incorporation of a reactive site for the reaction between the amorphous polyester segment and the styrene-acrylic copolymer segment into the amorphous polyester segment or the styrene-acrylic copolymer segment. In detail, process (1) prepares a styrene-acrylic copolymer segment with a compound having a site reactive with a carboxy group [—COOH] or a hydroxy group [—OH] remaining in the amorphous polyester segment and another site reactive with the styrene-acrylic copolymer segment besides the monomers forming the styrene-acrylic copolymer segment. This compound can react with the carboxy group [—COOH] or the hydroxyl group [—OH] in the amorphous polyester segment to chemically bond the amorphous polyester segment with the styrene-acrylic copolymer segment.

Alternatively, the amorphous polyester segment may be prepared with a bireactive monomer or a compound having a site reactive with the polyhydric alcohol or the polyvalent carboxylic acid and reactive with the styrene-acrylic copolymer segment.

The bireactive monomer may be of any type having a polymerizable unsaturated group and a group that can react with the polyvalent carboxylic acid monomer and/or the polyhydric alcohol monomer for forming the amorphous (or crystalline) polyester resin segment. Specific examples of the bireactive monomer include acrylic acid, methacrylic acid, fumaric acid, maleic acid, and maleic anhydride. In the present invention, the bireactive monomer is preferably acrylic acid or methacrylic acid.

Process (1) can prepare a styrene-acrylic modified polyester resin having a structure (grafted structure) composed of the amorphous polyester segment molecularly bonded to the styrene-acrylic copolymer segment.

(2) Bonding of preliminarily prepared amorphous polyester and styrene-acrylic copolymer segments to prepare a styrene-acrylic modified polyester resin.

In process (2), a polyvalent carboxylic acid and a polyhydric alcohol are polymerized into amorphous polyester segments through condensation reaction. Separately from the reaction system for preparing the amorphous polyester segments, styrene-acrylic copolymer segments are prepared from the aforementioned monomers through addition polymerization. Process (2) preferably involves incorporation of a site for the reaction between the amorphous polyester segment and the styrene-acrylic copolymer segment. The incorporation of such a reactive site is described above, and thus the detailed description thereof is omitted.

The resultant amorphous polyester segments are then reacted with the styrene-acrylic copolymer segments to prepare a styrene-acrylic modified polyester resin having a structure composed of the amorphous polyester segments molecularly bonded to the styrene-acrylic copolymer segments.

In the absence of the reactive sites in the amorphous polyester and styrene-acrylic copolymer segments, a system containing both the amorphous polyester and styrene-acrylic copolymer segments may be prepared, and a compound having a site for bonding to the amorphous polyester segment and the styrene-acrylic copolymer segment may be fed into the system. In this case, a styrene-acrylic modified polyester resin can be prepared which has a structure composed of the amorphous polyester segment molecularly bonded to the styrene-acrylic copolymer segment with the compound therebetween.

(3) Polymerization of styrene-acrylic copolymer segments in the presence of preliminarily prepared amorphous polyester segments to prepare a styrene-acrylic modified polyester resin.

In process (3), a polyvalent carboxylic acid and a polyhydric alcohol are polymerized into an amorphous polyester segment through condensation reaction. A styrene-acrylic copolymer segment is then prepared from monomers for the segment in the presence of the amorphous polyester segment. As in process (1), process (3) preferably involves incorporation of sites for the reaction between the amorphous polyester and styrene-acrylic copolymer segments. The incorporation of such a reactive site is described above, and thus the detailed description thereof is omitted.

Process (3) can prepare a styrene-acrylic modified polyester resin having a structure (grafted structure) composed of the styrene-acrylic copolymer segment molecularly bonded to the amorphous polyester segment.

Among processes (1) to (3), preferred is process (1), which can readily prepare a styrene-acrylic modified polyester resin having a structure composed of the amorphous polyester resin chain grafted to the amorphous resin chain through simplified production steps. In process (1), the styrene-acrylic copolymer segments are preliminarily prepared, and the amorphous polyester segments are then bonded to the styrene-acrylic copolymer segments. This process readily forms amorphous polyester segments of uniform orientation, and thus can reliably prepare a styrene-acrylic modified polyester resin suitable for the toner of the present invention.

The content of the polyester segments in the styrene-acrylic modified polyester resin is preferably 40 to 90 mass % relative to the entire amount of the styrene-acrylic modified polyester resin. The content of the styrene-acrylic copolymer segments in the styrene-acrylic modified polyester resin is preferably 10 to 60 mass % relative to the entire amount of the styrene-acrylic modified polyester resin. These segments having contents within such ranges facilitate control of the plasticity of the styrene-acrylic modified polyester resin.

If the amorphous resin contained in the core particle is not the styrene-acrylic resin, the styrene-acrylic copolymer segment may be replaced with an amorphous resin segment similar to the amorphous resin contained in the toner particle for the preparation of the styrene-acrylic modified polyester resin, to prepare a hybrid resin composed of the amorphous resin segment molecularly bonded to the amorphous resin contained in the core particle.

As used herein, the term "similar resins" refers to resins having the same characteristic chemical bond in their repeating units. The term "characteristic chemical bond" is defined in accordance with "Polymer classification" of Materials Database of National Institute for Materials Science (NIMS). The "characteristic chemical bonds" include chemical bonds in 22 types of polymers, i.e., polyacrylates, polyamides, polyacid anhydrides, polycarbonates, polydienes, polyesters, polyhaloolefins, polyimides, polyimines, polyketones, polyolefins, polyethers, polyphenylenes, polyphosphazenes, polysiloxanes, polystyrenes, polysulfides, polysulfones, polyurethanes, polyureas, polyvinyls, and miscellaneous polymers.

The term "similar resins" in the case of the copolymeric resin refers to resins having the same characteristic chemical bond in their repeating units of the monomer components in the copolymer. Thus, resins having the same characteristic chemical bond are regarded as similar resins, irrespective of the difference in characteristics of the resins or the molar proportion of the monomer components in the copolymer.

For example, a resin (or resin segment) composed of styrene, butyl acrylate, and acrylic acid and a resin (or resin segment) composed of styrene, butyl acrylate, and methacrylic acid have at least a chemical bond forming polyacrylate, and thus these resins are regarded as similar resins. In another example, a resin (or resin segment) composed of styrene, butyl acrylate, and acrylic acid and a resin (or resin segment) composed of styrene, butyl acrylate, acrylic acid, terephthalic acid, and fumaric acid have at least the same chemical bond forming polyacrylate. Thus, these resins are regarded as similar resins.

<<Core Particle>>

The core particle includes an amorphous resin, a colorant, a release agent, and a crystalline resin.

Hereinafter, the term "binder resin" refers to amorphous and crystalline resins contained in the core particle.

The core particle may contain any other material (e.g., resin and/or organic compound) besides the amorphous resin, the colorant, the release agent, and the crystalline resin within a range without sacrificing the advantageous effects of the present invention.

[Amorphous Resin Contained in Core Particle]

The amorphous resin contained in the core particle is preferably any of the above-exemplified amorphous resins usable for the shell layer. In the toner matrix particle, the amorphous resin contained in the core particle differs from the amorphous resin contained in the shell layer as described above.

The amorphous resin is preferably a styrene-acrylic resin that can impart charging properties stable against environmental variations (e.g., variations in humidity and temperature) to toner.

[Crystalline Resin]

The crystalline resin according to the present invention exhibits a clear endothermic peak, rather than a stepwise endothermic change, in differential scanning calorimetry (DSC) of the toner. The clear endothermic peak has a half width of 15° C. or less as determined by DSC at a heating rate of 10° C./min.

The toner contains the crystalline resin in an amount of preferably 3 to 30 mass %. In this case, the binder resin exhibits improved sharp-melting properties, resulting in improved low-temperature fixing properties of the toner. Incorporation of the crystalline resin can maintain the thermal resistance of the toner.

In the present invention, the content of the crystalline resin is preferably 5 to 40 parts by mass relative to 100 parts by mass of toner matrix particles for an improvement in low-temperature fixing properties and reduced gloss of images after fixation. A content of the crystalline resin of 5 parts by mass or more is enough for the resin to serve as a fixing aid and contributes to a reduction in fixing temperature of the toner. A content of the crystalline resin of 40 parts by mass or less leads to a reduction in amount of crystalline components, resulting in prevention of excess gloss of images after fixation.

The crystalline resin according to the present invention preferably includes a crystalline polyester resin. The crystalline polyester resin has ester bonds that can readily adsorb moisture. Thus, the toner can readily release electric charge and more effectively prevent adhesion between sheets having thermally fixed toner images.

The crystalline polyester resin will now be described in detail.

[Crystalline Polyester Resin]

The crystalline polyester resin is any known polyester resin prepared through polycondensation between a di- or higher-valent carboxylic acid (polyvalent carboxylic acid) and a di- or higher-valent alcohol (polyhydric alcohol) and exhibiting a clear endothermic peak.

The crystalline polyester resin according to the present invention preferably satisfies Expression (2):

$$5 \leq |C_{acid} - C_{alcohol}| \leq 12 \quad \text{Expression (2)}$$

where $C_{alcohol}$ represents the number of carbon atoms of the main chain of a structural unit derived from a polyhydric alcohol forming the crystalline polyester resin and $C_{acid}$ represents the number of carbon atoms of the main chain of a structural unit derived from a polyvalent carboxylic acid forming the crystalline polyester resin.

Each toner particle includes a crystalline polyester resin having alkyl chains of different lengths that are repeated via ester bonds satisfying Expression (2). This configuration prevents coagulation of particles of the crystalline polyester resin and thus formation of large crystal domains of the crystalline polyester resin even in high-temperature environments. Thus, the toner maintains fixing properties even after being stored at high temperatures.

From the viewpoint of effective achievement of similar advantageous effects, the crystalline polyester resin preferably satisfies Expression (3):

$$6 \leq |C_{acid} - C_{alcohol}| 10. \quad \text{Expression (3)}$$

From the viewpoint of effective achievement of similar advantageous effects, the crystalline polyester resin preferably satisfies Expression (4):

$$C_{alcohol} < C_{acid}. \quad \text{Expression (4)}$$

From the viewpoint of more effective achievement of the advantageous effects of the present invention, the number of carbon atoms of the main chain of the structural unit derived from the polyhydric alcohol forming the crystalline polyester resin (i.e., $C_{alcohol}$) is preferably 2 to 12, and the number of carbon atoms of the main chain of the structural unit derived from the polyvalent carboxylic acid forming the crystalline polyester component (i.e., $C_{acid}$) is preferably 6 to 16.

The crystalline polyester resin preferably has a melting point ($T_{mc}$) of 65 to 80° C. A melting point within this range leads to high compatibility between thermal resistance during storage and plasticity during fixation.

The melting point (Tm) can be measured by DSC. In specific, a crystalline resin sample is sealed in an aluminum pan (KIT NO. B0143013) and is placed on a sample holder of a thermal analyzer Diamond DSC (manufactured by PerkinElmer Inc.). The temperature of the sample is controlled through sequential processes of heating, cooling, and then heating. In each of the first and second heating processes, the sample is heated from room temperature (25° C.) to 150° C. at a rate of 10° C./min and maintained at 150° C. for five minutes. In the cooling process, the sample is cooled from 150° C. to 0° C. at a rate of 10° C./min and maintained at 0° C. for five minutes. The melting point (Tm) corresponds to the temperature at the maximum point of the peak in an endothermic curve obtained through the second heating process.

The crystalline polyester resin may be prepared through any known process. For example, the crystalline polyester resin can be prepared through polycondensation (esterification) between a polyvalent carboxylic acid component and a polyhydric alcohol component described below in the presence of any known esterification catalyst as in the preparation of the aforementioned amorphous polyester segment.

A dicarboxylic acid component is used as the polyvalent carboxylic acid component. The dicarboxylic acid component is preferably an aliphatic dicarboxylic acid, and may be used in combination with an aromatic dicarboxylic acid. The aliphatic dicarboxylic acid is preferably a linear-chain aliphatic dicarboxylic acid. The use of a linear-chain aliphatic dicarboxylic acid is advantageous for an improvement in crystallinity. Two or more dicarboxylic acid components may be used in combination.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid (dodecanedioic acid), 1,13-tridecanedicarboxylic acid, 1,14-tetradecanedicarboxylic acid, 1,16-hexadecanedicarboxylic acid, and 1,18-octadecanedicarboxylic acid. Lower alkyl esters and anhydrides of these acids may also be used.

Among the aforementioned aliphatic dicarboxylic acids, preferred are aliphatic dicarboxylic acids having 6 to 16 carbon atoms for achievement of the advantageous effects of the present invention. More preferred are aliphatic dicarboxylic acids having 10 to 14 carbon atoms.

Examples of the aromatic dicarboxylic acid that can be used in combination with the aliphatic dicarboxylic acid include terephthalic acid, isophthalic acid, o-phthalic acid, t-butylisophthalic acid, 2,6-naphthalenedicarboxylic acid, and 4,4'-biphenyldicarboxylic acid. Among these acids, preferred are terephthalic acid, isophthalic acid, and t-butylisophthalic acid, which can be readily available and emulsified.

The dicarboxylic acid component of the crystalline polyester resin contains an aliphatic dicarboxylic acid in an amount of preferably 50 mol % or more, more preferably 70 mol % or more, still more preferably 80 mol % or more, particularly preferably 100 mol %. An aliphatic dicarboxylic acid content of the dicarboxylic acid component of 50 mol % or more leads to sufficient crystallinity of the crystalline polyester resin.

A diol component is used as the polyhydric alcohol component. The diol component is preferably an aliphatic diol. The diol component may optionally contain any diol other than an aliphatic diol. The aliphatic diol is preferably a linear-chain aliphatic diol. The use of a linear-chain aliphatic diol is advantageous for an improvement in crystallinity. Two or more diol components may be used in combination.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecandiol, and 1,20-eicosanediol.

Among the aforementioned aliphatic diols, preferred are aliphatic diols having 2 to 12 carbon atoms for achievement of the advantageous effects of the present invention. More preferred are aliphatic diols having 4 to 6 carbon atoms.

Examples of the optional diol other than the aliphatic diol include diols having a double bond, and diols having a sulfonate group. Specific examples of the diols having a double bond include 2-butene-1,4-diol, 3-butene-1,6-diol, and 4-butene-1,8-diol.

The diol component of the crystalline polyester resin contains an aliphatic diol in an amount of preferably 50 mol % or more, more preferably 70 mol % or more, still more preferably 80 mol % or more, particularly preferably 100 mol %. An aliphatic diol content of the diol component of 50 mol % or more leads to sufficient crystallinity of the crystalline polyester resin, resulting in superior low-temperature fixing properties of the resultant toner, and glossy images provided by the toner.

The stoichiometric ratio of the hydroxy group [OH] of the diol component to the carboxy group [COOH] of the dicarboxylic acid component ([OH]/[COOH]) is preferably 2.0/1.0 to 1.0/2.0, more preferably 1.5/1.0 to 1.0/1.5, particularly preferably 1.3/1.0 to 1.0/1.3.

The crystalline polyester resin according to the present invention preferably has a weight average molecular weight (Mw) of 5,000 to 50,000 and a number average molecular weight (Mn) of 2,000 to 10,000 from the viewpoint of the gloss stability and low-temperature fixing properties of the toner.

The content of the crystalline polyester resin in the toner particles is preferably 1 to 20 mass %, more preferably 5 to 15 mass % in view of satisfactory low-temperature fixing properties and thermal resistance during storage. The aforementioned styrene-acrylic resin contributes to uniform dispersion of such an amount of the crystalline resin in the toner particles, leading to a reduction in further crystallization.

If the crystalline polyester resin satisfies the aforementioned definitions, the crystalline polyester resin may be derived from any crystalline polyester resin or may include a hybrid crystalline polyester resin described below. The hybrid crystalline polyester resin will now be briefly described.

[Hybrid Crystalline Polyester Resin (Hybrid Crystalline Resin)]

The hybrid crystalline polyester resin (hereinafter may be referred to simply as "hybrid crystalline resin") is a chemically bonded composite of a crystalline polyester resin segment and an amorphous resin segment other than the polyester resin.

The crystalline polyester resin segment is derived from any crystalline polyester resin. Thus, the crystalline polyester resin segment refers to a molecular chain having the same chemical structure as the crystalline polyester resin. The amorphous resin segment other than the polyester resin is derived from any amorphous resin other than the polyester resin. Thus, the amorphous resin segment other than the polyester resin refers to a molecular chain having the same chemical structure as the amorphous resin other than the polyester resin.

The crystalline polyester resin segment is derived from the aforementioned crystalline polyester resin, and exhibits a clear endothermic peak, rather than a stepwise endothermic change, by differential scanning calorimetry (DSC) of the toner.

The crystalline polyester resin segment satisfying the aforementioned definitions may be in any form. For example, the following copolymer resins correspond to the hybrid crystalline resin having the crystalline polyester resin segment according to the present invention: a resin composed of a crystalline polyester resin segment having a main chain copolymerized with any other component and a resin composed of a crystalline polyester resin segment copolymerized with the main chain of any other component, with the proviso that the toner containing such a copolymer resin exhibits the aforementioned clear endothermic peak.

The crystalline polyester resin segment is prepared through polycondensation (esterification) between a polyvalent carboxylic acid component and a polyhydric alcohol component used for the aforementioned crystalline polyester resin.

The crystalline polyester resin segment may be prepared through any known process. For example, the segment can be prepared through polycondensation (esterification) between the aforementioned polyvalent carboxylic acid and polyhydric alcohol in the presence of any known esterification catalyst as in the preparation of the aforementioned crystalline polyester resin.

The crystalline polyester resin segment is preferably prepared through polycondensation of the aforementioned polyvalent carboxylic acid and polyhydric alcohol and a compound that chemically bonds to the amorphous resin segment.

The hybrid crystalline resin contains the aforementioned crystalline polyester resin segment and an amorphous resin used for the shell layer (e.g., an amorphous resin segment other than polyester resin).

The content of the amorphous resin segment is preferably 3 mass % or more and less than 15 mass %, more preferably 5 mass % or more and less than 10 mass %, still more preferably 7 mass % or more and less than 9 mass %, relative to the entire amount of the hybrid crystalline resin. A content of the amorphous resin segment within the above range leads to sufficient crystallinity of the hybrid crystalline resin.

(Preparation of Hybrid Crystalline Polyester Resin)

The hybrid resin according to the present invention may be prepared by any process that can produce a polymer having a structure composed of the crystalline polyester resin segment and the amorphous resin segment molecularly bonded thereto. For example, the hybrid resin may be prepared in the same manner as described above in the section (preparation of styrene-acrylic modified polyester resin) except that the amorphous polyester segment is replaced with the crystalline polyester resin segment. In this case, the styrene-acrylic copolymer segment may be replaced with another amorphous resin segment.

[Colorant]

The colorant according to the present invention may be of any type, such as carbon black, a magnetic material, a dye, or a pigment. Examples of the carbon black include channel black, furnace black, acetylene black, thermal black, and lamp black. Examples of the magnetic material include ferromagnetic metals, such as iron, nickel, and cobalt; alloys of these metals; ferromagnetic metal compounds, such as ferrite and magnetite; alloys containing no ferromagnetic metal and exhibiting ferromagnetism through thermal treatment, such as Heusler alloys (e.g., manganese-copper-aluminum and manganese-copper-tin); and chromium dioxide.

Examples of the black colorant include carbon black materials, such as furnace black, channel black, acetylene black, thermal black, and lamp black; and powdery magnetic materials, such as magnetite and ferrite.

Examples of the magenta or red colorant include C. I. Pigment Reds 2, 3, 5, 6, 7, 15, 16, 48:1, 53:1, 57:1, 60, 63, 64, 68, 81, 83, 87, 88, 89, 90, 112, 114, 122, 123, 139, 144, 149, 150, 163, 166, 170, 177, 178, 184, 202, 206, 207, 209, 222, 238, and 269.

Examples of the orange or yellow colorant include C. I. Pigment Oranges 31 and 43, and C. I. Pigment Yellows 12, 14, 15, 17, 74, 83, 93, 94, 138, 155, 162, 180, and 185.

Examples of the green or cyan colorant include C. I. Pigment Blues 2, 3, 15, 15:2, 15:3, 15:4, 16, 17, 60, 62, and 66, and C. I. Pigment Green 7.

These colorants may be used alone or in combination.

The content of the colorant is preferably 1 to 30 mass %, more preferably 2 to 20 mass %, relative to the entire amount of the toner. The toner may contain any mixture of the aforementioned colorants. A content of the colorant within such a range leads to satisfactory color reproduction of images.

The colorant has a volume average particle size of 10 to 1,000 nm, preferably 50 to 500 nm, more preferably 80 to 300 nm.

[Release Agent]

Any known release agent may be used in the present invention. Examples of the release agent include polyolefin waxes, such as polyethylene wax and polypropylene wax; branched-chain hydrocarbon waxes, such as microcrystalline wax; long-chain hydrocarbon waxes, such as paraffin wax and Sasolwax; dialkyl ketone waxes, such as distearyl ketone; ester waxes, such as carnauba wax, montan wax, behenyl behenate, trimethylolpropane tribehenate, pentaerythritol tetrabehenate, pentaerythritol diacetate dibehenate, glycerin tribehenate, 1,18-octadecanediol distearate, tristearyl trimellitate, and distearyl maleate; and amide waxes, such as ethylenediaminebehenylamide and trimellitic acid tristearylamide.

The release agent has a melting point of preferably 40 to 160° C., more preferably 50 to 120° C. A melting point of the release agent within the above range leads to sufficient thermal resistance during storage of the toner. In addition, toner images can be reliably formed during fixation at a low temperature without causing cold offset. The release agent content of the toner is preferably 1 to 30 mass %, more preferably 5 to 20 mass %.

[Additional Component]

The toner matrix particles according to the present invention may optionally contain an internal additive (e.g., a charge controlling agent) or an external additive (e.g., inorganic microparticles, organic microparticles, or a lubricant) in addition to the aforementioned components.

<Charge Controlling Agent>

The charge controlling agent may be any known compound. Examples of such a compound include nigrosine dyes, metal salts of naphthenic acid and higher fatty acids, alkoxylated amines, quaternary ammonium salts, azo-metal complexes, and salicylic acid metal salts.

The content of the charge controlling agent is typically 0.1 to 10 mass %, preferably 0.5 to 5 mass %, relative to the entire amount (100 mass %) of the binder resin contained in the resultant toner matrix particles.

The charge controlling agent has a number average primary particle size of, for example, 10 to 1,000 nm, preferably 50 to 500 nm, more preferably 80 to 300 nm.

<<External Additive>>

The toner may contain any known external additive that can improve charging properties, fluidity, and cleanability. Examples of the additive include inorganic microparticles, organic microparticles, and lubricants. Such an external additive may be deposited onto the surfaces of the toner matrix particles.

The inorganic microparticles are preferably composed of, for example, silica, titania, alumina, or strontium titanate.

The inorganic microparticles may optionally be subjected to hydrophobic treatment.

The organic microparticles may be spherical organic microparticles having a number average primary particle size of about 10 to 2,000 nm. In detail, the organic microparticles may be composed of a homopolymer of styrene or methyl methacrylate or a copolymer of these monomers.

The lubricant is used for further improving the cleanability and transfer efficiency of the toner. Examples of the lubricant include metal salts of higher fatty acids, such as zinc, aluminum, copper, magnesium, and calcium salts of stearic acid, zinc, manganese, iron, copper, and magnesium salts of oleic acid, zinc, copper, magnesium, and calcium salts of palmitic acid, zinc and calcium salts of linoleic acid, and zinc and calcium salts of ricinoleic acid. These external additives may be used in combination.

The content of the external additive is preferably 0.1 to 10.0 mass % relative to the entire amount (100 mass %) of the toner matrix particles.

The external additive may be mixed with the toner matrix particles with any known mixer, such as a Turbula mixer, a Henschel mixer, a Nauta mixer, or a V-type mixer.

<<Expression (1) (Shape of Toner Matrix Particle)>>

The shape factor SF-2 of the toner matrix particle and the shape factor SF-2 of the core particle preferably satisfy the following Expression (1). This configuration contributes to reduced surface roughness (i.e., smooth surface) of the toner matrix particle and even deposition of an external additive onto the particle.

the shape factor SF-2 of the core particle>the shape factor SF-2 of the toner matrix particle Expression (1)

The shape factor SF-2 of the core particle is preferably 110 to 140 and the shape factor SF-2 of the toner matrix particle is preferably 100 to 110 for achievement of reduced surface roughness (i.e., smooth surface) of the toner matrix particle and even deposition of an external additive onto the particle.

<Calculation of Shape Factor SF-2>

The shape factor SF-2 of the toner matrix particle or the core particle is calculated on the basis of the cross-sectional image of the toner matrix particle. The shape factor SF-2 indicates the degree of surface irregularities of the toner matrix particle or the core particle.

In specific, the shape factors SF-2 of the toner matrix particle and the core particle are calculated by the following Expressions (2) and (3). A large shape factor SF-2 of a particle indicates that the particle has a very irregular shape.

the shape factor SF-2 of a toner matrix particle=(the perimeter of the toner matrix particle)$^2$/(the projection area of the toner matrix particle)×(¼π)×100 Expression (2)

the shape factor SF-2 of a core particle=(the perimeter of the core particle)$^2$/(the projection area of the core particle)×(¼π)×100 Expression (3)

For each observed toner particle, the shape factors SF-2 of the toner matrix particle and the core particle are calculated by the above-mentioned Expressions (2) and (3). In order to determine whether the toner satisfies Expression (1), the shape factors SF-2 of the toner matrix particle and the core particle are calculated for 20 or more toner particles, and then averaged.

<<Production of Toner>>

The toner for developing electrostatic charge images of the present invention may be produced by any known process; for example, a wet process in an aqueous medium (e.g., emulsion coagulation). An exemplary process (including Steps I to VI) for producing the toner will now be described, but the toner may be produced by any other process.

In the following description, the amorphous resin contained in the core particle is a styrene-acrylic resin. In Steps I to VI, the styrene-acrylic resin may be replaced with an amorphous polyester resin for the production of the toner. Thus, in Steps I to VI, the core particle may be composed of the amorphous polyester resin instead of the styrene-acrylic resin, and the shell layer may be composed of the styrene-acrylic resin instead of the amorphous polyester resin.

In a traditional toner having a core-shell structure (hereinafter may be referred to as "core-shell toner") including a core particle and a shell composed of different resins, small discrete particulate domains of the shell lie on the surface of the core particle due to strong cohesive force between similar resins. In contrast, the process including Steps I to VI detailed below can form a laminar shell on the surface of a core particle through control of the temperature and pH during the formation of the shell layer on the core particle. The resultant core-shell toner has a smoother surface than the traditional core-shell toner even if these toners have the same coverage of shell. Thus, the core-shell toner of the present invention is preferred in consideration of even deposition of an external additive.

Step I involves adding a coagulant to a dispersion mixture containing at least the styrene-acrylic resin and the release agent with agitation.

Step II involves adding a dispersion of the crystalline polyester resin to the coagulant-containing dispersion mixture prepared in Step I, and heating the mixture with agitation, to prepare a core particle dispersion through coagulation of at least the styrene-acrylic resin, the release agent, and the crystalline polyester resin.

Step III involves cooling the core particle dispersion prepared in Step II to a temperature equal to or lower than (the crystallization peak temperature ($T_{qc}$) of the crystalline polyester resin−15)° C.

Step IV involves adjusting the temperature of the core particle dispersion cooled in Step III to:

(1) a temperature equal to or lower than the melting point ($T_{mc}$) of the crystalline polyester resin;

(2) a temperature equal to or higher than (the glass transition temperature ($T_{gs}$) of the styrene-acrylic resin+5)° C.;

(3) a temperature equal to or lower than (the glass transition temperature ($T_{gs}$) of the amorphous polyester resin+3)° C.; and (4) a temperature satisfying the following expression: $T_{gs}<T_{ga}<T_{qc}$, and adding a dispersion of particles of the amorphous polyester resin to the core particle dispersion, to prepare a core-shell particle dispersion through deposition of particles of the amorphous polyester resin (i.e., shell particles) onto the surfaces of core particles.

Step V involves adjusting the temperature of the core-shell particle dispersion to be equal to or higher than (the glass transition temperature ($T_{ga}$) of the amorphous polyester resin+3)° C. and equal to or lower than the melting point ($T_{mc}$) of the crystalline polyester resin, to prepare a core-shell toner matrix particle dispersion through fusion between the core particles and the shell particles and fusion between the shell particles.

Step VI involves cooling the core-shell toner matrix particle dispersion prepared in Step V, separating core-shell toner matrix particles from the dispersion, and then drying the particles.

The crystallization peak temperature ($T_{qc}$) of a crystalline polyester resin, the melting point ($T_{mc}$) of the crystalline polyester resin, the glass transition temperature ($T_{gs}$) of a styrene-acrylic resin, and the glass transition temperature ($T_{ga}$) of an amorphous polyester resin are measured as described below. The crystallization peak temperature ($T_{qc}$) of the crystalline polyester resin, the melting point ($T_{mc}$) of the crystalline polyester resin, the glass transition temperature ($T_{gs}$) of the styrene-acrylic resin, or the glass transition temperature ($T_{ga}$) of the amorphous polyester resin can be controlled by adjustment of the composition (proportions) of monomers for the resin or the molecular weight of the resin.

(Measurement of Melting Point ($T_{mc}$) and Crystallization Peak Temperature ($T_{qc}$) of Crystalline Polyester Resin)

The melting point ($T_{mc}$) of the crystalline polyester resin in the toner can be measured with a differential scanning calorimeter "Diamond DSC" (manufactured by PerkinElmer, Inc.). In detail, a sample of the toner (3.0 mg) is sealed in an aluminum pan and placed on a sample holder of the calorimeter. The calorimetry is performed by the following temperature program: a first heating process involving heating from room temperature (25° C.) to 150° C. at a rate of 10° C./min and maintaining at 150° C. for five minutes; a cooling process involving cooling from 150° C. to 0° C. at a rate of 10° C./min and maintaining at 0° C. for five minutes; and a second heating process involving heating from 0° C. to 150° C. at a rate of 10° C./min. An empty aluminum pan is used as a reference.

An endothermic curve observed in the first heating process is analyzed, and the endothermic peak temperature of the crystalline polyester resin is defined as the melting point ($T_{mc}$) (° C.) of the crystalline polyester resin. An exothermic curve observed in the cooling process is analyzed, and the exothermic peak temperature of the crystalline polyester resin is defined as the crystallization peak temperature ($T_{qc}$) (° C.) of crystalline polyester resin.

(Measurement of Glass Transition Temperature ($T_{gs}$, $T_{ga}$) of Styrene-acrylic Resin and Amorphous Polyester Resin)

The glass transition temperature is determined with the aforementioned DSC apparatus. The temperature of a sample is controlled through sequential processes of heating, cooling, and heating (temperature range: 0 to 150° C., heating rate: 10° C./minute, cooling rate: 10° C./minute). The glass transition temperature can be determined on the basis of the data obtained through the second heating process. In detail, the glass transition temperature corresponds to the intersection of a line extending from the base line of the first endothermic peak and a tangent corresponding to the maximum slope between the rising point and maximum point of the first endothermic peak.

<Step I>

Step I involves adding a coagulant to a dispersion mixture containing at least the styrene-acrylic resin and the release agent with agitation.

The dispersion mixture is preferably prepared through mixing of a dispersion containing microparticles of the styrene-acrylic resin (amorphous resin microparticle dispersion) with a dispersion containing microparticles of the colorant in an aqueous medium.

If the release agent is not contained in the styrene-acrylic resin microparticles, the dispersion mixture is preferably mixed with a release agent microparticle dispersion.

For incorporation of an internal additive (other than the release agent) into the toner matrix particles, the internal additive may be incorporated in the amorphous polyester resin microparticles. Alternatively, a dispersion of internal additive microparticles may be separately prepared, and the dispersion may be added before or after the addition of the coagulant. In the case of addition of the internal additive microparticle dispersion following the addition of the coagulant, the dispersion is preferably added before completion of the addition of the crystalline polyester resin dispersion in Step II.

The styrene-acrylic resin microparticle dispersion, the colorant microparticle dispersion, and the release agent microparticle dispersion are prepared as described below.

(Preparation of Styrene-acrylic Resin Microparticle Dispersion)

The styrene-acrylic resin microparticle dispersion (amorphous resin microparticle dispersion) is prepared through synthesis of a styrene-acrylic resin and then dispersion of the styrene-acrylic resin in the form of microparticles in an aqueous medium.

The preparation of the styrene-acrylic resin is described above, and thus the detailed description thereof is omitted. For incorporation of a release agent into styrene-acrylic resin microparticles, the release agent is added during the polymerization of the styrene-acrylic resin. In this case, the styrene-acrylic resin is preferably prepared by a miniemulsion polymerization process.

The styrene-acrylic resin is dispersed in an aqueous medium by, for example, process (i) or (ii) described below. Process (i) involves formation of styrene-acrylic resin microparticles from a monomer for the styrene-acrylic resin, and preparation of an aqueous dispersion of the styrene-acrylic resin microparticles. Process (ii) involves dissolution or dispersion of the styrene-acrylic resin in an organic solvent to prepare an oil-phase solution, dispersion of the oil-phase solution in an aqueous medium through phase inversion emulsification to form oil droplets having a desired size, and removal of the organic solvent.

As used herein, the term "aqueous medium" refers to a medium containing water in an amount of 50 mass % or more. Examples of the component of the aqueous medium other than water include organic solvents miscible with water, such as methanol, ethanol, isopropanol, butanol, acetone, methyl ethyl ketone, dimethylformamide, methyl cellosolve, and tetrahydrofuran. Among these organic compounds, preferred are alcohol solvents, such as methanol, ethanol, isopropanol, and butanol, which cannot dissolve the resin. The aqueous medium preferably consists of water (e.g., deionized water).

Process (i) preferably involves addition of a monomer for the styrene-acrylic resin to an aqueous medium together with a polymerization initiator to prepare base particles through polymerization, and then addition of a radically polymerizable monomer for the styrene-acrylic resin and a polymerization initiator to a dispersion of the base particles for seed polymerization of the monomer with the base particles.

The polymerization initiator may be a water-soluble polymerization initiator. Preferred examples of the water-soluble polymerization initiator include water-soluble radical polymerization initiators, such as potassium persulfate and ammonium persulfate.

The seed polymerization system for preparation of the styrene-acrylic resin microparticles may involve the use of the aforementioned chain transfer agent for controlling the molecular weight of the styrene-acrylic resin. The chain transfer agent is preferably mixed with the resin materials in the aforementioned mixing step.

Process (ii) preferably involves the use of an organic solvent having a low boiling point and low solubility in water for preparation of the oil-phase solution because the solvent can be readily removed after formation of oil droplets. Specific examples of the organic solvent include methyl acetate, ethyl acetate, methyl ethyl ketone, isopropyl alcohol, methyl isobutyl ketone, toluene, and xylene. These organic solvents may be used alone or in combination.

The amount of an organic solvent (or the total amount of two or more organic solvents) is typically 10 to 500 parts by mass, preferably 100 to 450 parts by mass, more preferably 200 to 400 parts by mass, relative to 100 parts by mass of the styrene-acrylic resin.

The amount of the aqueous medium is preferably 50 to 2,000 parts by mass, more preferably 100 to 1,000 parts by mass, relative to 100 parts by mass of the oil-phase solution. An amount within the above range leads to formation of oil droplets having a desired size through effective emulsification and dispersion of the oil-phase solution in the aqueous medium.

The aqueous medium may contain a dispersion stabilizer. Alternatively, the aqueous medium may contain a surfactant or a microparticulate resin for improving the dispersion stability of oil droplets.

The dispersion stabilizer may be of any known type. The dispersion stabilizer is preferably of an acid- or alkali-soluble type, such as tricalcium phosphate, or an enzyme-degradable type from the environmental viewpoint.

Examples of the surfactant include known anionic surfactants, cationic surfactants, nonionic surfactants, and amphoteric surfactants.

Examples of the microparticulate resin for improving the dispersion stability include microparticulate poly(methyl methacrylate) resins, microparticulate polystyrene resins, and microparticulate poly(styrene-acrylonitrile) resins.

The oil-phase solution can be emulsified by use of mechanical energy with any disperser. Examples of the disperser include homogenizers, low-rate shearing dispersers, high-rate shearing dispersers, frictional dispersers, high-pressure jet dispersers, ultrasonic dispersers, and high-pressure impact dispersers (e.g., Ultimizer).

After the formation of the oil droplets, the entire dispersion of the styrene-acrylic resin microparticles in the aqueous medium is gradually heated under agitation and then maintained at a predetermined temperature under vigorous agitation, followed by removal of the organic solvent. The organic solvent may be removed with, for example, an evaporator at reduced pressure.

The styrene-acrylic resin microparticles (oil droplets) in the styrene-acrylic resin microparticle dispersion prepared by process (i) or (ii) have a volume median particle size of preferably 60 to 1,000 nm, more preferably 80 to 500 nm. The volume median particle size of the oil droplets can be adjusted by, for example, control of the mechanical energy during emulsification and dispersion.

The content of the styrene-acrylic resin microparticles in the styrene-acrylic resin microparticle dispersion is preferably 5 to 50 mass %, more preferably 10 to 30 mass %. A content of the styrene-acrylic resin microparticles within the above range leads to a narrow particles size distribution and an improvement in properties of the toner.

(Preparation of Colorant Microparticle Dispersion)

The colorant microparticle dispersion is prepared through dispersion of a colorant in the form of microparticles in an aqueous medium.

The aqueous medium is as described above in the section "preparation of styrene-acrylic resin microparticle dispersion." The aqueous medium may contain a surfactant or resin microparticles for improving the dispersion stability of the colorant.

The colorant may be dispersed in the aqueous medium by mechanical energy with any disperser. The disperser may be the same as described above in the section "preparation of styrene-acrylic resin microparticle dispersion."

The content of the colorant microparticles in the colorant microparticle dispersion is preferably 10 to 50 mass %, more preferably 15 to 40 mass %. A content of the colorant microparticles within the above range leads to satisfactory color reproduction of images.

(Preparation of Release Agent Microparticle Dispersion)

The release agent microparticle dispersion is prepared through dispersion of a release agent in the form of microparticles in an aqueous medium.

The aqueous medium is as described above in the section "preparation of styrene-acrylic resin microparticle dispersion." The aqueous medium may contain a surfactant or resin microparticles for improving the dispersion stability of the release agent.

The release agent may be dispersed in the aqueous medium by mechanical energy with any disperser. The disperser may be the same as described above in the section "preparation of styrene-acrylic resin microparticle dispersion."

The content of the release agent microparticles in the release agent microparticle dispersion is preferably 10 to 50 mass %, more preferably 15 to 40 mass %. A content of the release agent microparticles within the above range leads to satisfactory hot offset resistance and releasability of the toner.

(Coagulant)

The coagulant may be of any type and is preferably selected from metal salts. Examples of the metal salts include salts of monovalent metals, such as alkali metals (e.g., sodium, potassium, and lithium); and salts of divalent metals (e.g., calcium, magnesium, manganese, and copper); and salts of trivalent metals (e.g., iron and aluminum). Specific examples of the metal salts include sodium chloride, potassium chloride, lithium chloride, calcium chloride, magnesium chloride, zinc chloride, copper sulfate, magnesium sulfate, and manganese sulfate. Among these, divalent metal salts are particularly preferred. The use of a small amount of such a divalent metal salt can promote coagulation. These coagulants may be used alone or in combination.

After addition of the coagulant in Step I, the resultant mixture is preferably allowed to stand for only a short time until the start of heating. Preferably, Step II is initiated immediately after the addition of the coagulant in Step I, and the mixture is heated to a temperature equal to or higher than the melting point of the crystalline polyester resin and the glass transition temperature of the styrene-acrylic resin. If the mixture is allowed to stand for a long time before the heating, resin particles may fail to be uniformly coagulated, leading to a variation in particle size distribution of the toner matrix particles, and inconsistent surface properties of the toner matrix particles. The mixture is allowed to stand before the heating for typically 30 minutes or less, preferably 10 minutes or less. The coagulant is preferably added at a temperature equal to or lower than the glass transition temperature of the styrene-acrylic resin, more preferably at room temperature.

<Step II>

Step II involves adding a dispersion of the crystalline polyester resin to the coagulant-containing dispersion mixture prepared in Step I, and heating the mixture with agitation, to prepare a core particle dispersion through coagulation of at least the styrene-acrylic resin, the release agent, and the crystalline polyester resin.

As described above, Step II is preferably initiated immediately after the addition of the coagulant in Step I. The heating rate in Step II is preferably 0.8° C./min or more. The upper limit of the heating rate may be any value, and is preferably 15° C./min for avoiding formation of coarse particles due to rapid fusion. The mixture prepared in Step I is heated to a temperature equal to or higher than the glass transition temperature of the styrene-acrylic resin, preferably a temperature within a range of (the melting point of the crystalline polyester resin±10)° C. This heating promotes coagulation of microparticles of the styrene-acrylic resin and the colorant, to form coagulated particles.

The coagulation is preferably performed at an appropriately controlled number of times of agitation (for example, the dispersion mixture containing the crystalline polyester resin dispersion is agitated at a reduced agitation rate). The control of the number of times of agitation can reduce the collision and repulsion between particles, to promote contact between the particles and coagulation of the particles. The temperature of the mixture is preferably higher than the melting point of the crystalline polyester resin. While the temperature of the mixture is maintained, the number of times of agitation is appropriately controlled (e.g., the agitation rate is lowered) to promote coagulation of the crystalline polyester resin microparticles, the styrene-acrylic resin microparticles, and the colorant microparticles. After the particle size of the coagulated particles reaches a desired value, the mixture is cooled in Step III described below, and the coagulation is then terminated through addition of a coagulation terminator, such as an aqueous sodium chloride solution. The resultant coagulated particles preferably have a volume median particle size of 4.5 to 7.0 μm. The volume median particle size of the coagulated particles can be determined with an analyzer "Coulter Multisizer 3" (manufactured by Beckman Coulter, Inc.).

(Preparation of Crystalline Polyester Resin Dispersion)

The crystalline polyester resin dispersion is prepared through synthesis of a crystalline polyester resin and then dispersion of the crystalline polyester resin in the form of microparticles in an aqueous medium. Thus, the crystalline polyester resin dispersion may also be referred to as "crystalline polyester resin microparticle dispersion" below.

The crystalline polyester resin can be prepared as in the aforementioned process, and thus the redundant description is omitted.

The crystalline polyester resin preferably satisfies Expression (2): $5 \leq |C_{acid} - C_{alcohol}| \leq 12$ where $C_{alcohol}$ represents the number of carbon atoms of a polyhydric alcohol forming the resin and $C_{acid}$ represents the number of carbon atoms of a polyvalent carboxylic acid forming the resin.

The crystalline polyester resin microparticle dispersion is prepared through, for example, a process involving dispersion treatment of the resin in an aqueous medium without use of solvent, or a process involving dissolution of the resin in solvent (e.g., ethyl acetate, methyl ethyl ketone, toluene, or a general-purpose alcohol having a boiling point of lower than 100° C.), emulsification and dispersion of the solution in an aqueous medium with a disperser, and then removal of the solvent.

The crystalline polyester resin may have a carboxy group. In such a case, ammonia or sodium hydroxide may be added for ionic dissociation of the carboxy group contained in the resin and reliable and smooth emulsification in the aqueous phase.

The aqueous medium may contain a dispersion stabilizer. Alternatively, the aqueous medium may contain a surfactant or a microparticulate resin for improving the dispersion stability of oil droplets. The dispersion stabilizer, the surfactant, and the microparticulate resin may be the same as described in the section "preparation of styrene-acrylic resin microparticle dispersion."

The aforementioned dispersion treatment may be performed by use of mechanical energy with any disperser described above in the section "preparation of styrene-acrylic resin microparticle dispersion."

The crystalline polyester resin microparticles (oil droplets) in the crystalline polyester resin microparticle dispersion prepared as described above have a volume median particle size of preferably 50 to 1,000 nm, more preferably 50 to 500 nm, still more preferably 80 to 500 nm. The volume median particle size of the oil droplets can be adjusted by, for example, control of the mechanical energy during emulsification and dispersion.

The content of the crystalline polyester resin microparticles is preferably 10 to 50 mass %, more preferably 15 to 40 mass %, relative to the entire amount (100 mass %) of the crystalline polyester resin microparticle dispersion. A content of the crystalline polyester resin microparticles within the above range leads to a narrow particles size distribution and an improvement in properties of the toner.

<Step III>

Step III involves cooling the core particle dispersion prepared in Step II to a temperature equal to or lower than (the crystallization peak temperature ($T_{qc}$) of the crystalline polyester resin−15)° C.

If the core particle dispersion is cooled to the aforementioned temperature in Step III, the polyester resin is sufficiently crystalized, and the internal structure of the core particles is appropriately maintained. Thus, the orientation of the polyester resin to the amorphous polyester resin contained in the shell particles is minimized even after the addition and coagulation of the shell particles in Steps IV to V, resulting in formation of the aforementioned shell coat or shell coat domains.

The cooling temperature in Step III may be lower than 30° C. The cooling temperature, however, is preferably 30° C. or higher in view of production efficiency, since further cooling does not greatly affect subsequent steps and requires excessive heat exchange.

The cooling rate may be any value, but is preferably 0.2 to 20° C./min, more preferably 1.0 to 10° C./min. A cooling rate within the above range leads to appropriate control of the internal structure and shape of the core particles in association with further crystallization of the crystalline polyester resin in the core particles.

A cooling rate of 0.2° C./min or more leads to prevention of formation of irregular shape of core particles during further crystallization of the crystalline polyester resin, resulting in a desired shape of the toner.

A cooling rate of 20° C./min or less leads to sufficient crystallization of the crystalline polyester resin. Thus, excessive fusion between the crystalline polyester resin and the amorphous polyester resin can be prevented during coagulation of the shells in Step V, resulting in appropriate formation of shell coats or coat domains. The cooling may be performed by any process, such as a process involving introduction of a cooling medium from outside into the reaction vessel, or a process involving direct injection of cooling water into the reaction system.

<Step IV>

Step IV involves adjusting the temperature of the core particle dispersion cooled in Step III to:

(1) a temperature equal to or lower than the melting point ($T_{mc}$) of the crystalline polyester resin;

(2) a temperature equal to or higher than (the glass transition temperature ($T_{gs}$) of the styrene-acrylic resin+5)° C.;

(3) a temperature equal to or lower than (the glass transition temperature ($T_{ga}$) of the amorphous polyester resin+3)° C.; and (4) a temperature satisfying the following expression: $T_{gs}<T_{ga}<T_{qc}$, and adding a dispersion of particles of the amorphous polyester resin to the core particle dispersion, to prepare a core-shell particle dispersion through deposition of particles of the amorphous polyester resin (i.e., shell particles) onto the surfaces of core particles.

As described above, the following conditions are preferably satisfied:

(5) the glass transition temperature ($T_{gs}$) of the styrene-acrylic resin is 35 to 50° C.;

(6) the glass transition temperature ($T_{ga}$) of the amorphous polyester resin is 53 to 63° C.; and (7) the melting point ($T_{mc}$) of the crystalline polyester resin is 65 to 80° C.

The adjustment of the temperature of the core particle dispersion to be within such a range contributes to improvements in low-temperature fixing properties, thermal resistance during storage, durability, and plasticity during fixation.

Expressions (a) to (c) are preferably satisfied in Step IV:

$$3\leq(pH_A-pH_B) \quad \text{Expression (a)}$$

$$7\leq pH_A\leq 10, \text{ and} \quad \text{Expression (b)}$$

$$2\leq pH_B\leq 5 \quad \text{Expression (c)}$$

where $pH_A$ represents the pH of the core particle dispersion at 25° C., and $pH_B$ represents the pH of the amorphous polyester resin particle dispersion at 25° C. before being added to the core particle dispersion.

The pH adjustment under the conditions described in Expressions (a) to (c) promotes uniform coagulation of shell particles (amorphous polyester resin particles) and coating of core particles with shell particles. Since shell particles exhibit higher coagulability than core particles due to the difference in particle size therebetween, the adjustment of the $pH_A$ of the core particle dispersion to a high level promotes the dissociation of carboxyl groups on the surfaces of core particles to increase the coagulabiility of core particles, and the adjustment of the $pH_B$ of the shell particle dispersion to a low level inhibits coagulation between shell particles and promotes coagulation of shell particles with core particles.

In order to control the rate of coagulation between shell particles and core particles after addition of the amorphous polyester resin particle dispersion, the number of times of agitation may be adjusted, the core particle dispersion may be heated/cooled to a temperature within a range described above in (1) to (7), and a pH adjuster may be used for adjustment of the $pH_A$ and $pH_B$ to satisfy Expressions (a) to (c).

The pH adjuster may be any acid or alkali that dissolves in water. Specific examples of the pH adjuster are described below.

Examples of the alkali include inorganic bases, such as sodium hydroxide and potassium hydroxide, and ammonia. Examples of the acid include inorganic acids, such as hydrochloric acid, nitric acid, sulfuric acid, phosphoric acid, and boric acid; sulfonic acids, such as methanesulfonic acid, ethanesulfonic acid, and benzenesulfonic acid; and carboxylic acids, such as acetic acid, citric acid, and formic acid.

The amorphous polyester resin particles contained in the amorphous polyester resin particle dispersion added in Step IV preferably have a volume median particle size of 50 to 300 nm.

A volume median particle size of the amorphous polyester resin particles of 50 to 300 nm leads to even deposition of shells onto core particles, resulting in sufficient coverage by a reduced amount of the resin for the shells. A volume median particle size of 50 nm or more leads to prevention of coagulation between shell particles, whereas a volume median particle size of 300 nm or less leads to sufficient coverage of core particles with shell particles, resulting in prevention of excess exposure of the core particles.

(Measurement of pH)

The pH of the core particle dispersion at 25° C. ($pH_A$) and the pH of the amorphous polyester resin particle dispersion at 25° C. ($pH_B$) before being added to the core particle dispersion can be measured as described below.

In specific, the pH of the core particle dispersion at 25° C. and the pH of the amorphous polyester resin particle dispersion at 25° C. before being added to the core particle dispersion can be measured with a glass-electrode hydrogen ion concentration meter HM-20P (manufactured by DKK-TOA CORPORATION) (reference electrode internal solution RE-4 calibrated with the following three standard solutions: phthalate standard solution (pH 4.01, 25° C.), neutral phosphate standard solution (pH 6.86, 25° C.), and borate standard solution (pH 9.18, 25° C.)).

<Step V>

Step V involves adjusting the temperature of the core-shell particle dispersion to be equal to or higher than (the glass transition temperature ($T_{ga}$) of the amorphous polyester resin+3)° C. and equal to or lower than the melting point ($T_{mc}$) of the crystalline polyester resin, to prepare a core-shell toner matrix particle dispersion through fusion between the core particles and the shell particles and fusion between the shell particles.

<Step VI>

Step VI involves cooling the core-shell toner matrix particle dispersion prepared in Step V, separating core-shell toner matrix particles from the dispersion, and then drying the particles.

The core-shell toner matrix particles may be separated from the core-shell toner matrix particle dispersion by any known technique.

For example, the separation step may involve any filtration technique, such as centrifugation, filtration at reduced pressure with a Nutsche filter, or filtration with a filter press.

The separated core-shell toner matrix particles may optionally be washed. The washing step may involve removal of deposits (e.g., the surfactant and the coagulant) from the separated core-shell toner matrix particles (caked agglomeration of particles). The washing step is preferably continued until the conductivity of the washings reaches, for example, 1 to 10 μS/cm.

The separated or washed core-shell toner matrix particles are then dried. The drying step may be performed with any technique with, for example, any known dryer. Examples of such dryers include spray dryers, vacuum freeze dryers, reduced-pressure dryers, stationary shelf dryers, mobile shelf dryers, fluidized bed dryers, rotary dryers, and stirring dryers. The water content of the dried toner matrix particles is preferably 5 mass % or less, more preferably 2 mass % or less.

If the dried core-shell toner matrix particles are agglomerated by weak interparticle force, the agglomerated particles may be subjected to disintegration treatment. This treatment may involve the use of a mechanical disintegrator, such as a jet mill, a Henschel mixer, a coffee mill, or a food processor.

[Application of External Additive]

An external additive may optionally be applied to the core-shell toner matrix particles according to the present invention. This step involves optional addition of an external additive to the surfaces of the dried core-shell toner matrix particles to mix them, to produce a toner. The application of the external additive improves the fluidity, charging properties, and cleanability of the toner.

<<Developer>>

The toner of the present invention is suitable for the following use. For example, the toner may be used as a magnetic one-component developer containing a magnetic material. Alternatively, the toner may be mixed with a carrier and used as a two-component developer. Alternatively, the toner may be used alone as a non-magnetic toner.

The carrier for forming the two-component developer may be magnetic particles composed of any known material, such as a metal material (e.g., iron, ferrite, or magnetite) or an alloy of such a metal and aluminum or lead. Ferrite particles are particularly preferred.

The carrier has a volume average particle size of preferably 15 to 100 μm, more preferably 25 to 60 μm.

The carrier is preferably coated with a resin or in the form of a dispersion of magnetic particles in a resin. Non-limiting examples of the resin for coating of the carrier include olefinic resins, cyclohexyl methacrylate-methyl methacrylate copolymers, styrenic resins, styrene-acrylic resins, silicone resins, ester resins, and fluororesins. Non-limiting examples of the resin for forming the dispersion include known resins, such as acrylic resins, styrene-acrylic resins, polyester resins, fluororesins, and phenolic resins.

<<Fixation>>

The fixation of the toner of the present invention preferably involves the use of a contact heating process. Examples of the contact heating process include a thermal pressure fixing process, a thermal roller fixing process, and a thermocompression fixing process involving the use of a rotary pressure unit including a fixed heater.

The aforementioned embodiments of the present invention should not be construed to limit the invention, and various modifications of the invention may be made.

Examples

The present invention will now be described in detail by way of examples, which should not be construed to limit the present invention. In the following examples, the term "parts" and the symbol "%" refer to "parts by mass" and "mass %," respectively, unless otherwise specified.

<Preparation of Amorphous Resin Microparticle Dispersion (X1)>

(1) First Polymerization Step

Sodium dodecyl sulfate (8 parts by mass) and deionized water (3,000 parts by mass) were placed in a 5-L reactor equipped with an agitator, a thermosensor, a cooling tube, and a nitrogen feeder, and the mixture was agitated at 230 rpm under a nitrogen gas stream while the internal temperature was raised to 80° C. After the temperature reached 80° C., a solution of potassium persulfate (10 parts by mass) in deionized water (200 parts by mass) was added to the reactor, and the temperature of the mixture was raised again to 80° C. The following mixture of monomers was added dropwise to the reactor over one hour, and the resultant mixture was then heated and agitated at 80° C. for two hours for polymerization, to prepare resin microparticle dispersion (x1):

styrene, 480 parts by mass;
n-butyl acrylate, 250 parts by mass; and
methacrylic acid, 68 parts by mass.

(2) Second Polymerization Step

A solution of sodium polyoxyethylene (2) dodecyl ether sulfate (7 parts by mass) in deionized water (3,000 parts by mass) was placed in a 5-L reactor equipped with an agitator, a thermosensor, a cooling tube, and a nitrogen feeder, and was heated to 98° C. Resin microparticle dispersion (x1) (80 parts by mass in terms of solid content) and a mixture prepared through dissolution of the following monomers and release agent at 90° C. were added to the heated solution:

styrene, 285 parts by mass;
n-butyl acrylate, 95 parts by mass;
methacrylic acid, 20 parts by mass;
n-octyl 3-mercaptopropionate, 8 parts by mass; and
release agent: behenyl behenate (melting point: 73° C.), 190 parts by mass. The resultant mixture was processed for one hour in a mechanical disperser "CLEARMIX" having a circulation path (manufactured by M Technique Co., Ltd.), to prepare a dispersion containing emulsified particles (oil droplets).

A solution of potassium persulfate (6 parts by mass) in deionized water (200 parts by mass) (i.e., a polymerization initiator solution) was added to the dispersion containing emulsified particles (oil droplets). The mixture was heated with agitation for one hour at 84° C. for polymerization, to prepare resin microparticle dispersion (x2).

(3) Third Polymerization Step

Resin microparticle dispersion (x2) was then thoroughly mixed with deionized water (400 parts by mass), and a solution of potassium persulfate (11 parts by mass) in deionized water (400 parts by mass) was added to the mixture. The composition of the following monomers was added dropwise to the mixture over one hour at a temperature of 82° C.:

styrene, 437 parts by mass;
n-butyl acrylate, 17 parts by mass;
n-octyl acrylate, 143 parts by mass;
acrylic acid, 52 parts by mass; and
n-octyl 3-mercaptopropionate, 8 parts by mass. After completion of the dropwise addition, the resultant mixture was heated with agitation for two hours for polymerization and was cooled to 28° C., to prepare amorphous resin microparticle dispersion (X1) of vinyl resin (styrene-acrylic resin).

<Preparation of Colorant Microparticle Dispersion [Bk]>

Sodium dodecyl sulfate (90 parts by mass) was dissolved in deionized water (1,600 parts by mass) with agitation, and carbon black "REGAL 330R" (manufactured by Cabot Corporation) (420 parts by mass) was gradually added to the solution with agitation. The resultant mixture was then processed in an agitator "CLEARMIX" (manufactured by M Technique Co., Ltd.), to prepare colorant microparticle dispersion [Bk]. The colorant microparticles contained in colorant microparticle dispersion [Bk] had a volume median particle size of 120 nm as determined with an electrophoretic light scattering photometer "ELS-800" (manufactured by Otsuka Electronics Co., Ltd.).

<Preparation of Amorphous Resin Microparticle Dispersion (S1) for Shell)

The following monomers (including a bireactive monomer) for an addition-polymerization resin (styrene-acrylic resin: StAc) and radical polymerization initiator were added to a dropping funnel:

styrene, 80 parts by mass;

n-butyl acrylate, 20 parts by mass;

acrylic acid, 10 parts by mass; and polymerization initiator (di-t-butyl peroxide), 16 parts by mass.

The following monomers for a polycondensation resin (amorphous polyester resin) were added to a four-neck flask equipped with a nitrogen feeding tube, a dehydration tube, an agitator, and a thermocouple, and were dissolved at 170° C.:

propylene oxide (2 mol) adduct of bisphenol A, 285.7 parts by mass;

terephthalic acid, 66.9 parts by mass; and fumaric acid, 47.4 parts by mass.

The monomers for the addition-polymerization resin were added dropwise to the flask over 90 minutes and aged for 60 minutes, and then the unreacted monomers were removed at reduced pressure (8 kPa).

An esterification catalyst $Ti(OBu)_4$ (0.4 parts by mass) was then added to the reaction system. The reaction system was heated to 235° C. to allow the reaction to proceed at ambient pressure (101.3 kPa) for five hours, and then at reduced pressure (8 kPa) for one hour.

After the reaction system was cooled to 200° C., the reaction was continued at reduced pressure (20 kPa) until a desired softening point was achieved. The solvent was then removed to prepare resin (s1) for shell (amorphous resin). Resin (s1) for shell had a glass transition temperature ($T_g$) of 60° C. and a weight average molecular weight (Mw) of 30,000.

Resin (s1) for shell (100 parts by mass) was dissolved in ethyl acetate (manufactured by Kanto Chemical Co., Inc.) (400 parts by mass), and was mixed with a preliminarily prepared solution (638 parts by mass) of 0.26 mass % sodium lauryl sulfate. The mixed solution was ultrasonically dispersed with an ultrasonic homogenizer "US-150T" (manufactured by NIHONSEIKI KAISHA LTD.) at a V-LEVEL of 300 μA for 30 minutes with agitation. While the solution was maintained at 40° C., ethyl acetate was completely removed with a diaphragm vacuum pump "V-700" (manufactured by BUCHI) with agitation at reduced pressure for three hours, to prepare amorphous resin microparticle dispersion (S1) for shell (solid content: 13.5 mass %). The particles contained in amorphous resin microparticle dispersion (S1) for shell had a volume median particle size of 160 nm.

The amorphous resin for shell contained in amorphous resin microparticle dispersion (S1) for shell (i.e., "main resin contained in shell layer" illustrated in Table 1) corresponds to a styrene-acrylic modified amorphous polyester resin ("amorphous polyester resin" illustrated in Table 1).

<Synthesis of Crystalline Polyester Resin 1>

Dodecanedioic acid (281 parts by mass) and 1,6-hexanediol (283 parts by mass) were placed into a reactor equipped with an agitator, a thermometer, a cooling tube, and a nitrogen gas feeding tube. After the reactor was purged with dry nitrogen gas, $Ti(OBu)_4$ (0.1 parts by mass) was added to the mixture, and the mixture was agitated for eight hours under a nitrogen gas stream at about 180° C. for reaction. $Ti(OBu)_4$ (0.2 parts by mass) was further added to the mixture, and the mixture was agitated for six hours at an elevated temperature of about 220° C. for reaction. The internal pressure of the reactor was then reduced to 1333.2 Pa, and crystalline polyester resin 1 was prepared through reaction at reduced pressure. Crystalline polyester resin 1 had a number average molecular weight (Mn) of 5,500, a number average molecular weight (Mn) of 18,000, and a melting point ($T_{mc}$) of 67° C.

<Preparation of Crystalline Resin Microparticle Dispersion (C1)>

Crystalline polyester resin 1 (30 parts by mass) was melted and transferred to an emulsifier "Cavitron CD1010" (manufactured by EUROTEC LIMITED) at a rate of 100 parts by mass/min. Aqueous ammonia (70 parts by mass) was diluted with deionized water in an aqueous solvent tank. While being heated with a heat exchanger at 100° C., the diluted aqueous ammonia (concentration: 0.37 mass %) was transferred to the emulsifier "Cavitron CD1010" (manufactured by EUROTEC LIMITED) at a rate of 0.1 L/min simultaneous with the transfer of the melted crystalline polyester resin 1. The emulsifier "Cavitron CD1010" (manufactured by EUROTEC LIMITED) was operated at a rotor speed of 60 Hz and a pressure of 5 kg/cm$^2$, to prepare crystalline resin microparticle dispersion (C1) of crystalline polyester resin 1 (solid content: 30 parts by mass). The particles contained in crystalline resin microparticle dispersion (C1) had a volume median particle size of 200 nm.

<Production of Toner [1]>

Amorphous resin microparticle dispersion (X1) (200 parts by mass in terms of solid content) (the amorphous resin corresponding to "main resin contained in core particle" illustrated in Table 1), colorant microparticle dispersion [Bk] (20 parts by mass in terms of solid content), and deionized water (2,000 parts by mass) were placed in a reactor equipped with an agitator, a thermosensor, and a cooling tube. A 5 mol/L aqueous sodium hydroxide solution was then added to the reactor to adjust the pH of the mixture to 10. A solution of magnesium chloride (60 parts by mass) in deionized water (60 parts by mass) was added to the mixture with agitation at 25° C. over 10 minutes (Step I).

The resultant mixture was heated to 78° C. over 90 minutes, and crystalline resin microparticle dispersion (C1) (20 parts by mass in terms of solid content) ("crystalline resin content" illustrated in Table 1) was added to the mixture over 20 minutes. The number of times of agitation was appropriately controlled, and the particle size of associated particles was determined with a particle size analyzer "Coulter Multisizer 3" (manufactured by Beckman Coulter, Inc.). The coagulation of the associated particles was continued until the volume median particle size of the particles reached 5.5 μm, to prepare a core particle dispersion (Step II)

The resultant dispersion was cooled to 45° C. (Step III).

A 5 mol/L aqueous sodium hydroxide solution was added to the cooled core particle dispersion to adjust the pH of the dispersion to 8 (at 25° C.). The core particle dispersion was then heated to 63° C. Subsequently, amorphous resin microparticle dispersion (S1) for shell (pH 2) (20 parts by mass in terms of solid content) was added to the core particle dispersion over 20 minutes to deposit shell particles onto the surfaces of core particles. A solution of sodium chloride (190 parts by mass) in deionized water (760 parts by mass) was added to the resultant mixture to terminate the growth (coagulation) of the particles (Step IV).

The resultant dispersion was heated and agitated at 74° C. ("fusion temperature" illustrated in Table 2) to allow the fusion of the particles to proceed for 50 minutes ("fusion time" illustrated in Table 2). The dispersion was cooled to 35° C. to terminate the fusion of the particles (Step V).

Toner cake was prepared by solid-liquid separation and then dehydration and was redispersed in deionized water. This operation cycle was repeated three times for washing. The resultant product was then dried at 40° C. for 24 hours to prepare toner matrix particles (Step VI).

(Treatment with External Additive)

Hydrophobic silica particles (number average primary particle size: 12 nm, hydrophobicity: 68) (0.6 parts by mass) and hydrophobic titanium oxide particles (number average primary particle size: 20 nm, hydrophobicity: 63) (1.0 part by mass) were added to the resultant toner matrix particles (100 parts by mass), and were mixed with a Henschel mixer (manufactured by Nippon Coke & Engineering Co., Ltd.) at a circumferential velocity of a rotary blade of 35 mm/sec and 32° C. for 20 minutes. Coarse particles were then removed with a sieve having an opening of 45 μm, followed by treatment with an external additive, to produce toner [1].

<Production of Toners [2] to [5] and [7] to [9]>

Toners [2] to [5] and [7] to [9] were produced as in toner [1], except that the fusion time and the fusion temperature after deposition of shell particles onto the surfaces of core particles and termination of coagulation of the particles were modified as illustrated in Table.

<Production of Toner [6]>

Toner [6] was produced as in toner [1], except that amorphous resin microparticle dispersion (X1) was replaced with amorphous resin microparticle dispersion (S1) for shell, and amorphous resin microparticle dispersion (S1) for shell was replaced with amorphous resin microparticle dispersion (X1).

<Production of Toner [10]>

Toner [10] was produced as in toner [1], except that amorphous resin microparticle dispersion (S1) for shell was replaced with amorphous resin microparticle dispersion (X1).

<Production of Toner [11]>

Toner [11] was produced as in toner [1], except that amorphous resin microparticle dispersion (X1) was replaced with crystalline resin microparticle dispersion (C1).

<Production of Toner [12]>

Toner [12] was produced as in toner [1], except that amorphous resin microparticle dispersion (S1) for shell was added at 78° C. over 20 minutes without cooling to 45° C. nor heating to 63° C. after production of core particles (Step II), and the resultant dispersion was agitated for 50 minutes and then cooled to 35° C., to terminate the fusion of the particles.

<Production of Toner [13]>

Toner [13] was produced as in toner [1], except that crystalline resin microparticle dispersion (C1) was used in an amount of 50 parts by mass in terms of solid content.

<Production of Toner [14]>

Toner [14] was produced as in toner [1], except that crystalline resin microparticle dispersion (C1) was used in an amount of 2 parts by mass in terms of solid content.

TABLE 1

| | Constitution of toner | | | | | Shape of toner | | | | | |
|---|---|---|---|---|---|---|---|---|---|---|---|
| Toner No. | Main resin contained in core particle | Main resin contained in shell layer | Crystalline resin content [parts by mass] | Coverage [%] | Number of shell domains | Shape facter of core particle SF-2 | Shape factor of toner matrix particle SF-2 | Toner matrix particle size D50 [μm] | Average ratio of length L | Inter-face | Note |
| [1] | Styrene-acrylic resin | Amorphous polyester resin | 20 | 85 | 5 | 125 | 105 | 6.1 | 0.170 | None | Example |
| [2] | Styrene-acrylic resin | Amorphous polyester resin | 20 | 99 | 4 | 125 | 107 | 6.0 | 0.248 | None | Example |
| [3] | Styrene-acrylic resin | Amorphous polyester resin | 20 | 60 | 4 | 123 | 103 | 6.1 | 0.150 | None | Example |
| [4] | Styrene-acrylic resin | Amorphous polyester resin | 20 | 85 | 1 | 132 | 107 | 5.9 | 0.850 | None | Example |
| [5] | Styrene-acrylic resin | Amorphous polyester resin | 20 | 90 | 7 | 120 | 102 | 6.0 | 0.129 | None | Example |
| [6] | Amorphous polyester resin | Styrene-acrylic resin | 20 | 85 | 4 | 128 | 108 | 5.8 | 0.213 | None | Example |
| [7] | Styrene-acrylic resin | Amorphous polyester resin | 20 | 80 | 6 | 104 | 115 | 6.2 | 0.133 | None | Example |
| [8] | Styrene-acrylic resin | Amorphous polyester resin | 20 | 100 | 1 | 128 | 104 | 5.7 | 1.000 | None | Comparative Example |
| [9] | Styrene-acrylic resin | Amorphous polyester resin | 20 | 50 | 5 | 134 | 102 | 6.2 | 0.100 | None | Comparative Example |

TABLE 1-continued

| | Constitution of toner | | | | | Shape of toner | | | | | |
|---|---|---|---|---|---|---|---|---|---|---|---|
| Toner No. | Main resin contained in core particle | Main resin contained in shell layer | Crystalline resin content [parts by mass] | Coverage [%] | Number of shell domains | Shape facter of core particle SF-2 | Shape factor of toner matrix particle SF-2 | Toner matrix particle size D50 [μm] | Average ratio of length L | Inter-face | Note |
| [10] | Styrene-acrylic resin | Styrene-acrylic resin | 20 | 85 | 4 | 124 | 106 | 5.9 | 0.213 | None | Comparative Example |
| [11] | Crystalline polyester | Amorphpous polyester resin | 20 | 85 | 4 | 114 | 101 | 6.3 | 0.213 | None | Comparative Example |
| [12] | Styrene-acrylic resin | Amorphous polyester resin | 20 | 70 | 15 | 125 | 145 | 5.8 | 0.047 | None | Comparative Example |
| [13] | Styrene-acrylic resin | Amorphous polyester resin | 50 | 85 | 5 | 128 | 104 | 6.0 | 0.170 | None | Example |
| [14] | Styrene-acrylic resin | Amorphous polyester resin | 2 | 85 | 5 | 123 | 105 | 6.1 | 0.170 | None | Example |

TABLE 2

| | Conditions for fusion of shell | | |
|---|---|---|---|
| Toner No. | Fusion time [min] | Fusion temperature [° C.] | Note |
| [1] | 50 | 74 | Example |
| [2] | 30 | 74 | Example |
| [3] | 70 | 74 | Example |
| [4] | 50 | 72 | Example |
| [5] | 50 | 76 | Example |
| [6] | 50 | 74 | Example |
| [7] | 10 | 74 | Example |
| [8] | 20 | 74 | Comparative Example |
| [9] | 100 | 74 | Comparative Example |
| [10] | 50 | 74 | Comparative Example |
| [11] | 50 | 74 | Comparative Example |
| [12] | 50 | 78 | Comparative Example |
| [13] | 50 | 74 | Example |
| [14] | 50 | 74 | Example |

<<Number of Shell Domains and Shape of Toner Particle>>

The volume median particle size (D50) of particles of each of toners [1] to [14] was measured, and the number of shell domains and the shape of toner particles were determined by observation of a cross section prepared as described below.

The volume median particle size (D50) of toner particles was measured by the process as described above. The volume median particle size (D50) of toner particles corresponds to "toner matrix particle size (D50)" illustrated in Table 1.

[Observation of Cross Section of Toner Particle]

Apparatus: transmission electron microscope "JSM-7401F" (manufactured by JEOL Ltd.)

Sample: a section of a toner particle stained with ruthenium tetroxide ($RuO_4$) (thickness of section: 60 to 100 nm)

Accelerating voltage: 30 kV

Magnification: 10,000

Conditions for observation: transmission electron detector, bright field image

<Preparation of Section of Toner Particle)

A toner (1 to 2 mg) was placed into a 10-mL sample vial to be expanded therein and stained with vaporized ruthenium tetroxide ($RuO_4$) as described below. The resultant toner was dispersed in a photocurable resin "D-800" (manufactured by JEOL Ltd.) and then photo-cured to form a block. The block was then sliced with a microtome having a diamond knife into an ultrathin sample having a thickness of 60 to 100 nm.

(Treatment with Ruthenium Tetroxide)

The ruthenium tetroxide treatment involves the use of a vacuum electron staining apparatus VSC1R1 (manufactured by Filgen, Inc.). In detail, the toner or ultrathin sample was introduced into a ruthenium tetroxide-containing sublimation chamber (staining chamber) provided in the apparatus, and then stained with ruthenium tetroxide at room temperature (24 to 25° C.) and concentration level 3 (300 Pa) for 10 minutes.

<Observation of Dispersed Particles>

A cross-sectional image of toner particles was captured with an electron microscope "JSM-7401F" (manufactured by JEOL Ltd.) within 24 hours after staining. FIG. 2 is an example of cross-sectional image of a toner particle.

Toner particles were analyzed on the basis of data prepared by photographing (20 visual fields) of cross sections having a diameter within a range of volume median particle size (D50) of toner particles±10%. Hereinafter, the toner particles in the 20 visual fields will be referred to as "20 samples" or simply as "samples."

[Determination of Coverage]

The coverage of the shell layer in a toner particle is calculated on the basis of the cross section of the toner matrix particle observed as described above.

In detail, the cross section of the toner matrix particle was photographed with an electron microscope (JSM-7401F (manufactured by JEOL Ltd.) (accelerating voltage: 30 kV, magnification: 10,000). The photographic image was analyzed with an image processing analyzer LUZEX AP (manufactured by NIRECO CORPORATION) for determination of the length of the interface between the shell domains and the embedding resin and the perimeter of the cross section of the toner matrix particle.

The coverage of the shell layer is calculated by the following expression:

$$\text{coverage}=(A/B)\times 100$$

where A represents the length of the interface between the shell domains and the embedding resin, and B represents the perimeter of the cross section of the toner matrix particle.

The presence of a core-shell structure in the toner according to the present invention can be confirmed by the photographic image of the toner cross section; i.e., observation of a black (or gray) region corresponding to the core particle containing the colorant or the release agent, and a white region corresponding to the shell domains (i.e., surface layer of the toner matrix particle). The colorant cannot be identified during observation of the cross section stained under the aforementioned conditions. In the observed core particle, a white portion corresponds to the release agent while a black (or gray) portion corresponds to the crystalline polyester resin where the black portion is darker than a portion corresponding to the amorphous resin (styrene-acrylic resin) contained in the core particle. As described above, 20 toner particles (samples) were photographed with an electron microscope.

<Determination of the Number of Shell Domains>

The number of shell domains was determined on the basis of the cross-sectional image of the toner matrix particle used for calculation of the coverage.

In the cross-sectional photographic image, a shell domain corresponds to a white region having a thickness of 0.7 to 18% of the volume median particle size (D50) of the toner matrix particles and being in contact with the core particle at the interface having a length of 1.5% or more of the volume median particle size (D50) of the toner matrix particles. The number of such discrete shell domains was counted for the aforementioned 20 samples. Table 1 illustrates the average number of the shell domains. It was also determined whether each shell domain had a continuous phase (i.e., no interface between shell domains). The results are illustrated in Table 1 (corresponding to the column "interface").

<Calculation of Perimeter of Core Particle and Average Length L of Interface Between Core Particle and Shell Layer>

The length L of the interface between the core particle and the shell layer was calculated on the basis of the cross-sectional image of the toner matrix particle.

In detail, the cross section of the toner matrix particle was photographed with a transmission electron microscope JEM-2000FX (manufactured by JEOL Ltd.) (accelerating voltage: 30 kV, magnification: 10,000). The resultant cross-sectional image of the toner matrix particle was analyzed with an image processing analyzer LUZEX AP (manufactured by NIRECO CORPORATION) for determination of the perimeter of the core particle and the length L of the interface between the core particle and the shell layer.

In the toner matrix particle, the "average of the lengths L of core particle-shell layer interfaces" corresponds to the quotient of the sum of the lengths L divided by the number of shell domains.

The "average the lengths L of core particle-shell layer interfaces" was calculated for each sample (total: 20 samples), and the resultant values were averaged to determine a "length $L_{20}$."

The perimeters of core particles was determined for 20 samples, and the resultant values were averaged (average core particle perimeter).

Table 1 illustrates "average ratio of length L"; i.e., the quotient of length $L_{20}$ divided by average core particle perimeter (corresponding to the quotient of coverage divided by the number of shell domains). An average ratio of length L equal to or greater than ⅛of average core particle perimeter indicates that the average of lengths L in each toner matrix particle is equal to or greater than ⅛of the perimeter of the core particle of the toner matrix particle.

<Calculation of Shape Factor SF-2>

The shape factors SF-2 of the toner matrix particle and the core particle were calculated by Expressions (2) and (3) on the basis of the cross-sectional image of the toner matrix particle. A large shape factor SF-2 of a particle indicates that the particle has a very irregular shape.

The shape factors SF-2 of the toner matrix particle and the core particle were calculated for each sample (the average value is illustrated in Table 1). The average value was used for determining whether the toner satisfied Expression (1).

[Production of Developer]

Each of toners [1] to [14] was mixed with a silicone-resin-coated ferrite carrier (volume median particle size (D50): 60 μm) (toner concentration: 6.50 mass %) to produce a developer.

<<Evaluation>>

[Evaluation Apparatus]

Each developer was placed into a developing unit of a commercial color copier "bizhub PRO C1060" (manufactured by KONICA MINOLTA, INC.), and test images were formed for evaluation of the developer.

<Evaluation of Low-Temperature Fixing Properties (Under Offset)>

The under offset is an image defect involving detachment of a toner from a transfer medium (e.g., a sheet) due to insufficient fusion of the toner heated by a fixing unit.

Each produced toner and the developer were sequentially placed into the developing unit for evaluation of low-temperature fixing properties. The color copier was modified such that the fixing temperature, the amount of a toner to be deposited, and the system rate were adjustable. In detail, a solid image (toner density: 11.3 g/m$^2$) was printed on sheets NPI (128 g/m$^2$) (manufactured by Nippon Paper Industries Co., Ltd.) with the modified apparatus. The fixation rate was adjusted to 300 mm/sec, the temperature of a fixing belt was varied from 100 to 200° C. in 5° C. increments, and the temperature of a fixing roller was adjusted to 100° C. The temperature of the fixing belt was measured during fixation, and the minimum fixing temperature at which no under offset occurred was determined for evaluation of low-temperature fixing properties. A lower minimum fixing temperature indicates superior low-temperature fixing properties. A toner exhibiting a minimum fixing temperature of lower than 145° C. was acceptable.

A: A minimum fixing temperature of lower than 120° C.

B: A minimum fixing temperature of 120° C. or higher and lower than 135° C.

C: A minimum fixing temperature of 135° C. or higher and lower than 145° C.

D: A minimum fixing temperature of 145° C. or higher

<Thermal Resistance During Storage (50% Aggregation Temperature)>

A toner (0.5 g) was placed in a 10-mL glass vial having an inner diameter of 21 mm. The vial was sealed with a lid and was shaken 600 times at room temperature with Tap Denser KYT-2000 (manufactured by Seishin Enterprise Co., Ltd.). The lid was removed, and the vial was left at 57.5° C. and 35% RH for two hours. Subsequently, the toner was carefully placed on a 48-mesh sieve (opening: 350 μm) to prevent disintegration of agglomerates of the toner. The sieve was set on a powder tester (manufactured by Hosokawa Micron) and was fixed with a presser bar and a knob nut. The intensity of vibration was adjusted (vibration width: 1 mm), and the sieve was vibrated for 10 seconds. The proportion (mass %) of the residual toner on the sieve was determined.

The toner aggregation rate was calculated from the following expression:

$$\text{toner aggregation rate (\%)} = (\text{mass (g) of the residual toner on the sieve})/0.5\ \text{(g)} \times 100$$

The thermal resistance during storage of a toner was evaluated on the basis of the following criteria:

A: a toner aggregation rate of less than 10 mass % (very high thermal resistance during storage of toner)

B: a toner aggregation rate of 10 mass % or more and less than 15 mass % (high thermal resistance during storage of toner)

C: a toner aggregation rate of 15 mass % or more and less than 20 mass % (slightly poor thermal resistance during storage of toner, practically acceptable)

D: a toner aggregation rate of 20% or more (poor thermal resistance during storage of toner, practically unacceptable)

<Releasability During Fixation>

Paper sheets used for evaluation (Kinfuji, 85 g/m$^2$, long-grain paper) (manufactured by Oji Paper Co., Ltd.) were conditioned at normal temperature and normal humidity (NN environment: 25° C., 50% RH) overnight. Entirely solid images with different toner densities (g/m$^2$) were printed on the sheets under the following fixation conditions: top margin: 5 mm, temperature (fixing temperature) of upper heating pressure member: 195° C., and temperature (fixing temperature) of lower heating pressure member: 120° C. The toner density (g/m$^2$) of the solid image immediately before occurrence of paper jam was determined and defined as "critical toner density" for evaluation of releasability during fixation. A higher critical toner density indicates superior releasability. A toner exhibiting a critical toner density of 1.0 g/m$^2$ or more was acceptable. This test was performed at normal temperature and normal humidity (NN environment: 25° C., 50% RH).

<Image Gloss Stability>

A solid image (toner density: 4 mg/cm$^2$) was printed on a size A4 high glossy sheet "POD Gloss Coat (basis weight: 128 g/m$^2$)" (manufactured by Oji Paper Co., Ltd.) and a size A4 low glossy sheet "POD Mat Coat (basis weight: 128 g/m$^2$)" (manufactured by Oji Paper Co., Ltd.) at normal temperature and normal humidity (20° C., 50% RH). The gloss of the solid image was measured with a gloss meter "Gardner Micro-Gloss 75°" (manufactured by BYK-Gardner). The gloss stability was evaluated on the basis of the following criteria. The results are illustrated in Table 3. A toner exhibiting rating "B" or "C" was acceptable.

B: a difference in gloss level between the solid image and a blank of 10% or less C: a difference in gloss level between the solid image and a blank of more than 10% and 20% or less D: a difference in gloss level between the solid image and a blank of more than 20%

<Durability (Fogging Density)>

Absolute image densities were measured at 20 points of a non-printed white sheet "CF Paper (80 g/m$^2$)" (manufactured by KONICA MINOLTA, INC.) with a Macbeth densitometer "RD-918" (manufactured by Gretag Macbeth GmbH) and were averaged (blank density). A solid image of bands (image area ratio: 5%) was printed on 100,000 sheets. Absolute image densities were measured at 20 points of a white portion of the 100,000th printed sheet and then averaged (average density). The blank density was subtracted from the average density to determine a fogging density. The results are illustrated in Table 3. A toner exhibiting a fogging density of less than 0.010 was practically acceptable.

<Charging Properties>

A mixture of a carrier (19 g) and a toner (1 g) was placed in a 20-mL glass vial, and the vial was shaken for 20 minutes (rate: 200 times/min, shaking angle: 45°, arm: 50 cm) at normal temperature and normal humidity (20° C., 50% RH). The charge level of the toner was determined by a blow-off process described below. In detail, the carrier-toner mixture was blown by nitrogen gas for 10 seconds at a blowing pressure of 0.5 kgf/cm$^2$ (0.049 MPa) with a blow-off charge meter "TB-200" (manufactured by Toshiba Chemical Corporation) equipped with a 400-mesh stainless steel screen. The measured electric charge was divided by the mass of the separated toner to determine the charge level (μC/g) of the toner. A toner exhibiting a charge level of 30 μC/g or more was practically acceptable. The results are illustrated in Table 3.

<Toner Retention (Fixation at Fold)>

Fixation at fold was evaluated as described below. In detail, a solid image was printed on a test sheet, the sheet was folded, and the folded portion was rubbed with a finger three times. Subsequently, the test sheet was unfolded, and the solid image was wiped with "JK Wiper" (manufactured by NIPPON PAPER CRECIA Co., LTD.) three times. The density of the solid image was measured at the folded portion with a Macbeth densitometer "RD-918" and the fixation at fold was calculated by Expression (5). A toner exhibiting a fixation at fold of 70% or more was practically acceptable.

$$\text{fixation at fold (\%)} = [(\text{image density after folding})/(\text{image density before folding})] \times 100 \quad \text{Expression (5):}$$

TABLE 3

| Toner No. | Low-temperature fixing properties | Thermal resistance during storage | Releasability during fixation [g/m$^2$] | Image gloss stability | Durability | Charging properties [μC/g] | Fixation at fold [%] | Note |
|---|---|---|---|---|---|---|---|---|
| [1] | B | B | 4.0 | B | 0.002 | 45 | 95 | Example |
| [2] | B | A | 1.7 | B | 0.002 | 42 | 78 | Example |
| [3] | B | C | 4.2 | B | 0.008 | 40 | 93 | Example |
| [4] | B | A | 1.6 | B | 0.005 | 43 | 79 | Example |
| [5] | B | C | 4.1 | B | 0.007 | 34 | 94 | Example |
| [6] | C | B | 3.5 | B | 0.004 | 40 | 85 | Example |
| [7] | C | C | 3.7 | B | 0.008 | 36 | 87 | Example |
| [8] | C | A | 0.8 | B | 0.003 | 41 | 68 | Comparative Example |
| [9] | B | D | 4.0 | B | 0.014 | 43 | 91 | Comparative Example |
| [10] | D | B | 3.2 | B | 0.005 | 40 | 84 | Comparative Example |
| [11] | A | B | 3.6 | D | 0.006 | 40 | 82 | Comparative Example |
| [12] | C | B | 3.4 | B | 0.016 | 23 | 83 | Comparative Example |
| [13] | A | C | 4.0 | B | 0.003 | 34 | 88 | Example |
| [14] | C | A | 1.4 | C | 0.004 | 41 | 73 | Example |

This application is based upon and claims the benefit of priority from the prior Japanese Patent Application No. 2016-039574 filed on Mar. 2, 2016, the entire contents of which are incorporated herein by reference.

What is claimed is:

1. An electrostatic charge image developing toner comprising:

a toner matrix particle having a core-shell structure, wherein the toner matrix particle contains: a core particle including an amorphous resin, a colorant, a release agent, and a crystalline resin; and a shell layer coating a surface of the core particle at a coverage of 60 to 99%, the shell layer includes an amorphous resin, the amorphous resin contained in the shell layer is an amorphous polyester resin, the amorphous resin contained in the core particle is a styrene-acrylic resin, the amorphous polyester resin contained in the shell layer includes a styrene-acrylic modified polyester having a structure including a polyester molecular chain molecularly bonded to styrene-acrylic copolymer molecular chain, the amorphous resin contained in the core particle is composed of different monomers than the amorphous resin contained in the shell layer, and the toner matrix particle has one to seven discrete shell domains determined by observation of a cross section of the toner matrix particle with an electron microscope.

2. The electrostatic charge image developing toner of claim 1, wherein a content of the crystalline resin is 5 to 40parts by mass.

3. The electrostatic charge image developing toner of claim 1, wherein the crystalline resin is a crystalline polyester resin.

4. The electrostatic charge image developing toner of claim 3, wherein the crystalline polyester resin has a melting point of 65 to 80° C.

5. The electrostatic charge image developing toner of claim 3, wherein the crystalline polyester resin has a weight average molecular weight (Mw) of 5,000 to 50,000.

6. The electrostatic charge image developing toner of claim 3, wherein the crystalline polyester resin has a number average molecular weight (Mn) of 2,000 to 10,000.

7. The electrostatic charge image developing toner of claim 3, wherein the content of the crystalline polyester resin in the toner parties is 1 to 20 mass %.

8. The electrostatic charge image developing toner of claim 1, wherein each of the shell domains has no cracks.

9. The electrostatic charge image developing toner of claim 1, wherein the shell layer coats the surface of the core particle at a coverage of 80 to 90%.

10. The electrostatic charge image developing toner of claim 1, wherein a following expression is satisfied:

an average of lengths L is equal to or greater than ⅛ of a perimeter of the core particle, where L represents a length of an interface between the core particle and a shell domain determined by observation of a cross section of the toner matrix particle.

11. The electrostatic charge image developing toner of claim 1, wherein a shape factor SF-2 of the toner matrix particle and a shape factor SF-2 of the core particle satisfy Expression (1):

Expression (1): the shape factor SF-2 of the core particle >the shape factor SF-2 of the toner matrix particle.

12. The electrostatic charge image developing toner of claim 1, wherein the toner matrix particle has a volume median particle size of 3 to 10 μm.

13. The electrostatic charge image developing toner of claim 1, wherein the toner matrix particle has a volume median particle size of 5.5 to 7 μm.

14. The electrostatic charge image developing toner of claim 1, wherein the amount of the styrene acrylic copolymer segment contained in the styrene acrylic modified polyester in the shell layer is 5 to 30 mass %.

15. The electrostatic charge image developing toner of claim 1, wherein the amount of the styrene acrylic copolymer segment contained the styrene acrylic modified polyester in the shell layer is 5 to 20 mass %.

16. The electrostatic charge image developing toner of claim 1, wherein the content of the styrene acrylic modified polyester in the shell layer is 70 to 100 mass %.

17. The electrostatic charge image developing toner of claim 1, wherein the content of the styrene acrylic modified polyester in the shell layer is 90 to 100 mass.

18. The Electrostatic charge image developing toner of claim 1, wherein the amorphous polyester resin has a number average molecular weight (Mn) of 2,000 to 10,000.

* * * * *